US012006707B2

(12) United States Patent
Pietila et al.

(10) Patent No.: US 12,006,707 B2
(45) Date of Patent: Jun. 11, 2024

(54) MACHINE FOR REMOVING FORMWORK FROM CEILING STRUCTURE

(71) Applicant: Somero Enterprises, Inc., Ft. Myers, FL (US)

(72) Inventors: Mark A. Pietila, Atlantic Mine, MI (US); Trevor Eenigenburg, Houghton, MI (US); Ryan Kangas, Calumet, MI (US)

(73) Assignee: Somero Enterprises, Inc., Ft. Myers, MI (US)

( * ) Notice: Subject to any disclaimer, the term of this patent is extended or adjusted under 35 U.S.C. 154(b) by 0 days.

(21) Appl. No.: 18/364,499

(22) Filed: Aug. 3, 2023

(65) Prior Publication Data

US 2023/0374799 A1 Nov. 23, 2023

Related U.S. Application Data

(62) Division of application No. 17/933,129, filed on Sep. 19, 2022, now Pat. No. 11,719,008, which is a (Continued)

(51) Int. Cl.
*E04G 19/00* (2006.01)
*E01C 19/00* (2006.01)
(Continued)

(52) U.S. Cl.
CPC ..... *E04G 19/003* (2013.01); *E01C 19/006* (2013.01); *E04F 21/244* (2013.01); *E04G 21/066* (2013.01)

(58) Field of Classification Search
CPC ..... E04G 19/003; E04G 19/006; E04G 19/00; E04G 21/066; E04G 21/167; E04F 21/244
See application file for complete search history.

(56) References Cited

U.S. PATENT DOCUMENTS 4,655,633 A * 4/1987 Somero ..... E01C 19/006 404/75
4,930,935 A * 6/1990 Quenzi ..... E01C 19/405 404/114
(Continued)

FOREIGN PATENT DOCUMENTS

CA 2781450 A1 6/2011
CA 2781450 C * 5/2017 ..... B28B 7/18
(Continued)

OTHER PUBLICATIONS

International Search Report and Written Opinion dated Apr. 1, 2021 for corresponding PCT Application No. PCT/US2020/070883.

*Primary Examiner* — Bayan Salone
(74) *Attorney, Agent, or Firm* — HONIGMAN LLP

(57) ABSTRACT

A machine for removing formwork from underneath a concrete slab includes a wheeled base movable on and supported at a support structure, a raisable and lowerable structure disposed on the wheeled base, and a formwork-removal device attached to the raisable and lowerable structure. The formwork-removal device includes (i) an arm extending from the raisable and lowerable structure and (ii) at least one pneumatic gripper disposed at a distal end of the arm. With the raisable and lowerable structure adjusted to position the pneumatic gripper under the formwork and engaged with the formwork, and when the pneumatic gripper is activated, the pneumatic gripper applies a suction to secure the formwork at the pneumatic gripper. With the formwork secured at the pneumatic gripper, and when the pneumatic gripper is lowered, the pneumatic gripper applies a separating force to the formwork to remove the formwork from the concrete slab.

17 Claims, 44 Drawing Sheets

Related U.S. Application Data division of application No. 17/247,371, filed on Dec. 9, 2020, now Pat. No. 11,447,966.

(60) Provisional application No. 63/198,227, filed on Oct. 5, 2020, provisional application No. 62/705,839, filed on Jul. 17, 2020, provisional application No. 62/947,663, filed on Dec. 13, 2019.

(51) Int. Cl.

| | |
|---|---|
| ***E04F 21/24*** | (2006.01) |
| ***E04G 21/00*** | (2006.01) |
| ***E04G 21/06*** | (2006.01) |

(56) References Cited

U.S. PATENT DOCUMENTS

| | | | | |
|---|---|---|---|---|
| 6,976,805 | B2 * | 12/2005 | Quenzi | E01C 19/006 404/114 |
| 7,044,681 | B2 | 5/2006 | Quenzi et al. | |
| 7,121,762 | B2 * | 10/2006 | Quenzi | E01C 19/41 404/114 |
| 7,144,191 | B2 * | 12/2006 | Kieranen | E01C 19/40 701/50 |
| 7,195,423 | B2 * | 3/2007 | Halonen | E01C 19/42 404/115 |
| 7,396,186 | B2 * | 7/2008 | Quenzi | E04G 21/066 404/84.1 |
| 8,282,067 | B2 * | 10/2012 | Schwoerer | E04G 13/066 249/27 |
| 8,651,448 | B2 * | 2/2014 | Rosati | E04G 19/00 249/18 |
| 10,190,268 | B2 * | 1/2019 | Pietila | E04F 21/24 |
| 11,447,966 | B2 | 9/2022 | Pietila et al. | |
| 11,719,008 | B2 | 8/2023 | Pietila et al. | |

FOREIGN PATENT DOCUMENTS

| | | | | | |
|---|---|---|---|---|---|
| CN | 205558288 | U | * | 9/2016 | |
| CN | 205558288 | U | | 9/2016 | |
| FR | 2754555 | A1 | * | 4/1998 | E04G 19/003 |
| FR | 2754555 | A1 | | 4/1998 | |
| GB | 1305328 | A | | 1/1973 | |
| JP | 2001082095 | A | * | 3/2001 | |
| JP | 2001082095 | A | | 3/2001 | |
| WO | 2014124695 | A1 | | 8/2014 | |
| WO | WO-2014124695 | A1 | * | 8/2014 | E04G 11/02 |

* cited by examiner

MACHINE FOR REMOVING FORMWORK FROM CEILING STRUCTURE

CROSS REFERENCE TO RELATED APPLICATIONS

The present application is a division of U.S. patent application Ser. No. 17/933,129, filed Sep. 19, 2022, now U.S. Pat. No. 11,719,008, which is a division of U.S. patent application Ser. No. 17/247,371, filed Dec. 9, 2020, now U.S. Pat. No. 11,447,966, which claims the filing benefits of U.S. provisional application Ser. No. 63/198,227, filed Oct. 5, 2020, U.S. provisional application Ser. No. 62/705,839, filed Jul. 17, 2020, and U.S. provisional application Ser. No. 62/947,663, filed Dec. 13, 2019, which are all hereby incorporated herein by reference in their entireties.

FIELD OF THE INVENTION

The present invention relates generally to concrete structures and floors of buildings and the processes of installing and removing beams and panels or formwork used to form concrete structures and floors of buildings.

BACKGROUND OF THE INVENTION

Formwork includes temporary or permanent molds or supports into or onto which concrete or similar materials are poured in order to create walls and slabs of buildings. In known building practice, formwork is assembled on a surface or on a lower floor level to form the next level of the building above. Once the concrete slab has sufficiently hardened, the formwork may be removed. Traditional plywood formwork is built on site, with the plywood panels being supported on beams and shoring posts. It is easy to produce but time-consuming and dangerous to build and to remove, particularly for larger structures.

SUMMARY OF THE INVENTION

The present invention provides a system or machine for safe and efficient removal of the panels and beams of formwork systems. The machine includes a motorized, wheeled base having a raisable platform that can extend upward toward the formwork to be removed. The machine may be adapted to remove plywood or formwork from the underside of a placed and cured slab or ceiling structure, or the machine may be adapted to remove beams that support the plywood or formwork at the underside of the placed and cured slab or ceiling structure. Optionally, the machine may be adapted or controlled to install or position beams at the support posts or plywood or formwork on the beams.

In accordance with an aspect of the invention, the machine operates to remove plywood formwork from the underside of a concrete slab. The machine includes a formwork-removal apparatus, which is attached to the raisable platform, and which includes an arm, a wedge element, and a formwork-retaining mechanism. The wedge element includes one or more wedges attached to the arm. As the machine is maneuvered, the wedge mechanism engages the formwork, applying a separating force to partially separate or free the formwork from the slab. As the formwork is partially separated or freed, the formwork-retaining mechanism secures the partially separated formwork at the arm for removing the formwork and moving the removed formwork to a targeted location where it can be stacked and/or stored for reuse.

In accordance with another aspect of the present invention, the machine provides a beam-removal apparatus. The beam-removal apparatus includes an arm and a beam-gripping mechanism. The beam-gripping mechanism may comprise a gripper that conforms to and clamps at the central section of an I-beam. Optionally, the beam-removal apparatus may include a rotary actuator so that the gripper may grip the beam and the rotary actuator may twist the beam to free the beam for removal. The machine may reposition the removed beam and may stack the removed beams at a targeted location.

These and other objects, advantages, purposes and features of the present invention will become apparent upon review of the following specification in conjunction with the drawings.

DETAILED DESCRIPTION

To create poured-concrete slabs of buildings, workers assemble formwork panels to define spaces that are then filled with concrete. The formwork panels, which typically comprise individual sheets of plywood supported on beams, support the poured concrete until the slab or wall has sufficiently hardened, at which time workers remove the formwork as refuse or for reuse. For example, workers may remove the formwork from one level of a multi-level building after the concrete hardens and use the formwork to form the next higher level of the building. Traditionally, workers assemble formwork for upper-level slabs using plywood panels supported from below by a system of beams bearing the weight of the poured concrete as it hardens. The beams, in turn, are supported by shoring posts resting on a firm base, such as a lower-level slab. When the upper-level slab hardens sufficiently, workers manually disassemble and remove the beams that support the plywood panels, then pull or pry the formwork panels free from the bottom or underside of the slab. This process is tedious and time consuming and exposes workers to hazards, such as from falling material. The formwork-removal and/or beam-removal machines of the present disclosure streamline this process, reducing costs while increasing worker safety.

Referring to FIGS. 1-7, a formwork removing machine or device 110 for removing panels and beams of formwork systems includes a wheeled, motorized base 111, a lift mechanism 112 disposed at the wheeled base 111, and a formwork-removal apparatus or device 114 attached at the lift mechanism 112 for removing formwork. For purposes of this disclosure, the term "formwork" may refer to plywood sheets, support beams, or other materials applicable within the context of the usage.

The wheeled base 111 has four wheels, which may be independently powered wheels, and which may be independently steered, permitting a high degree of maneuverability on the job site. The four wheels may each be steered by, for example, pivoting around a vertical axis and having independent steering mechanisms. Optionally, the front wheels and/or the rear wheels may be steered in tandem by, for example, both of either the front and/or rear wheels being connected to an axle. Optionally, other wheel configurations may be used such as, for example, a three-wheeled base or a base having more than four wheels, or a base propelled by tracks driven by rotationally driven wheels.

Figure 18:
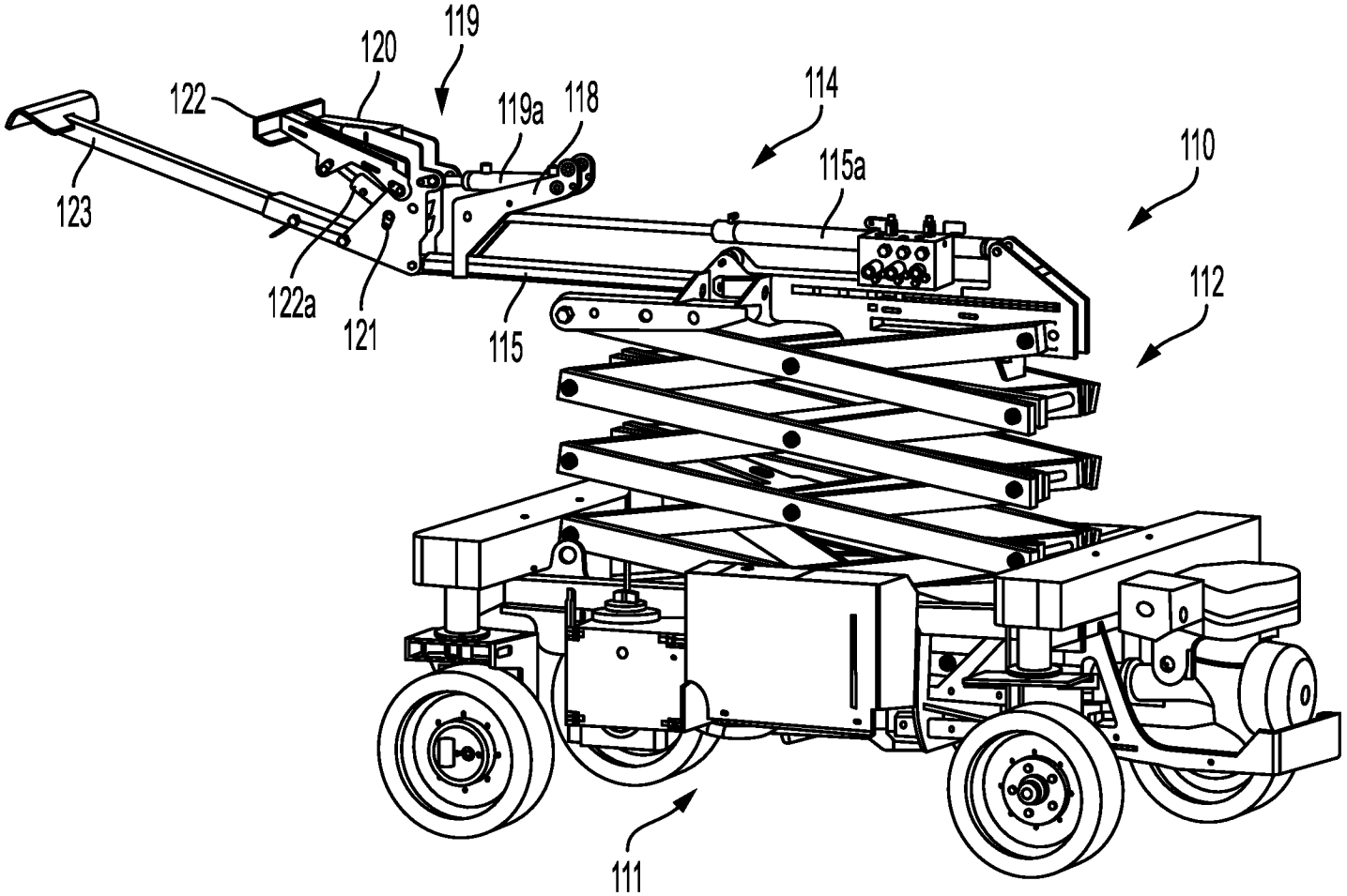
FIG. 18 is a perspective view of the formwork removing machine, shown with the boom in the extended position and the grasping device tilted upward relative to a support structure.
Figure 19:
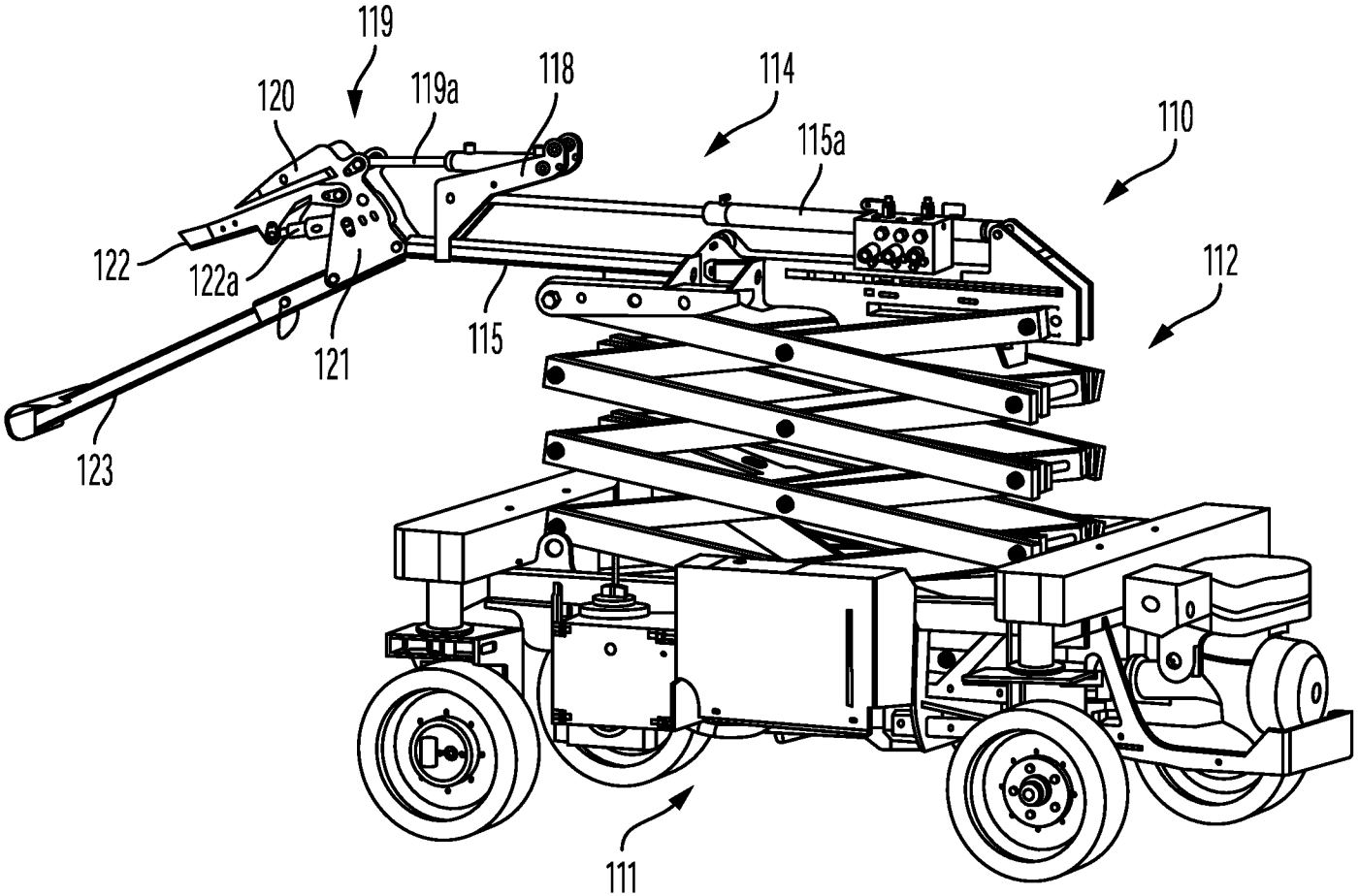
FIG. 19 is a perspective view of the formwork removing machine of FIG. 18, shown with the grasping device tilted downward relative to the support structure.

In the illustrated embodiment, the lift mechanism 112 comprises a scissor lift having a plurality of pivotally connected sections that pivot relative to one another to raise and lower the formwork removal device via the extension and retraction of a hydraulic cylinder 112*a* disposed at the base 111. The scissor lift, when extended or raised, lifts or moves the formwork-removal device 114 from a position near or resting on the base 111 (FIGS. 12-17) to a position at or near the formwork (FIGS. 1-7) for removal of the formwork from the underside of the concrete slab, as discussed below. The scissor lift, when retracted (as shown in FIGS. 12-17), folds into a compact configuration on or above the wheeled base 111, with the formwork-removal device 114 lowered down to the lowered or retracted state. As shown in FIGS. 12-17, the lift structure 112, when lowered or retracted, may stow at least partially in a cavity at the wheeled base 111 such that the machine 110 may be more compact for storage or maneuverability. The lift structure 112 may also hold a variety of different height positions, as illustrated in FIGS. 18 and 19, so as to reach formwork at differing elevations from the wheeled base 111.

Figure 1:
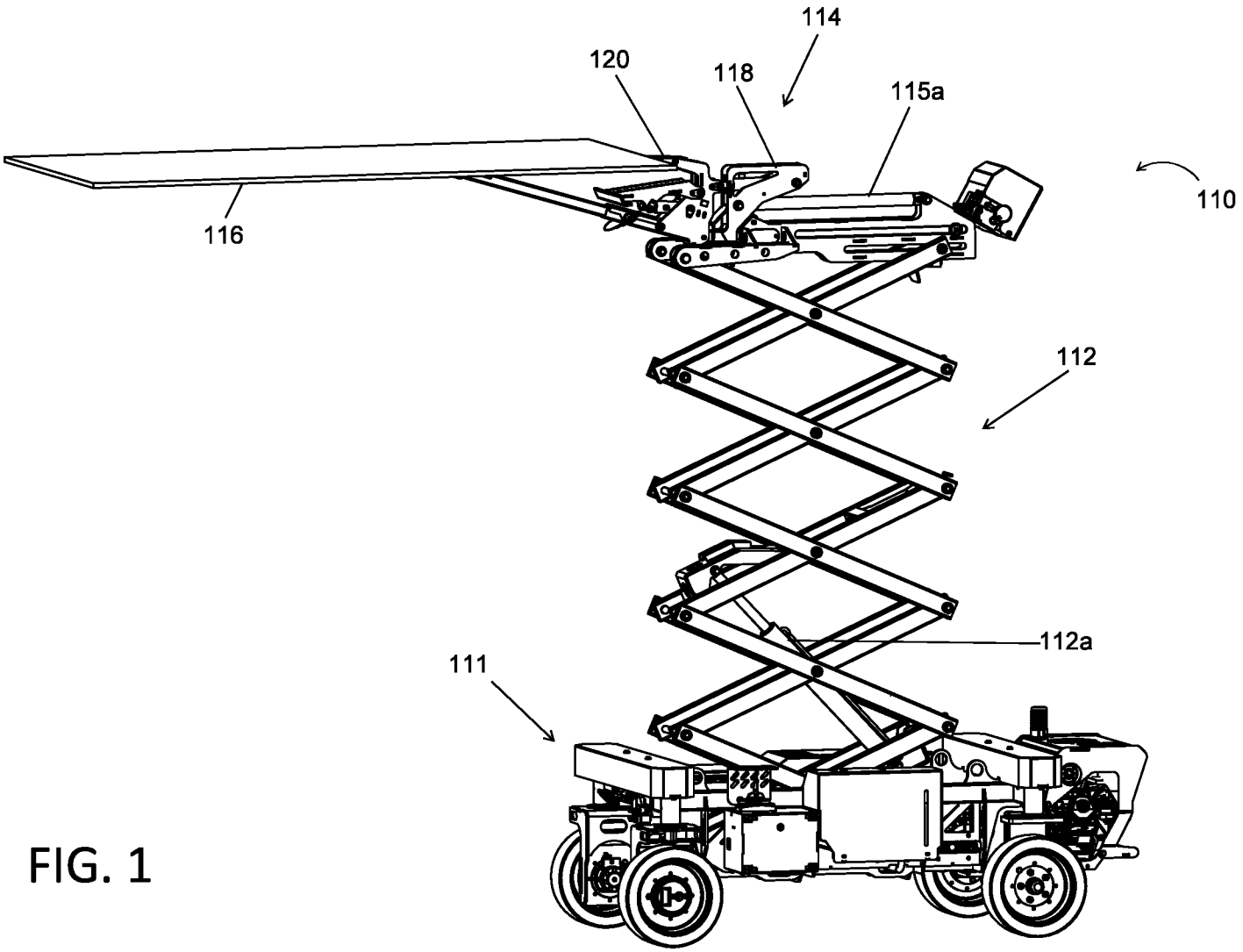
FIGS. 1 and 2 are perspective views of a formwork removing machine for removing plywood formwork, shown with a lift structure extended to a raised or extended position and a grasping element in an open state.
Figure 2:
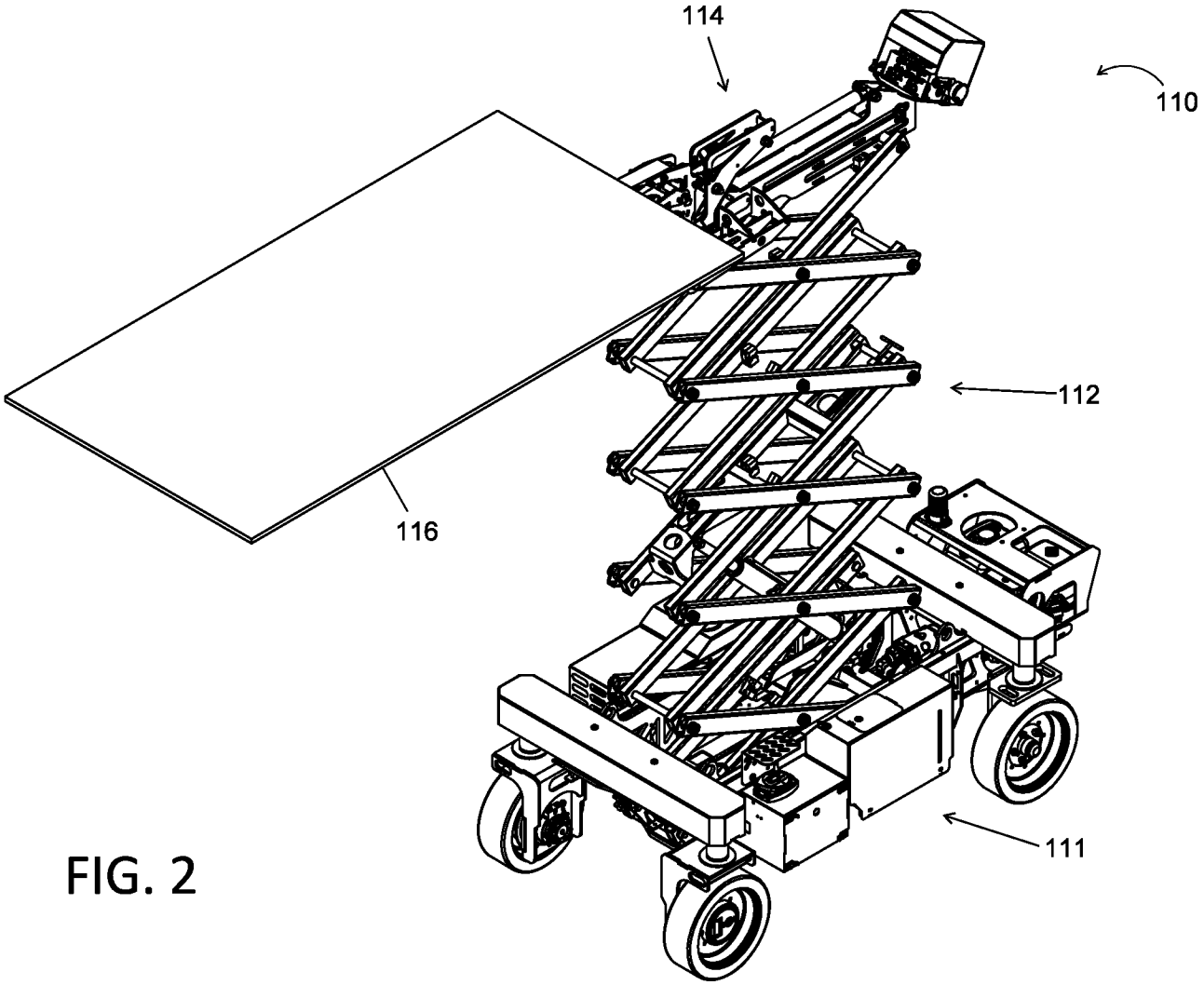
Figure 3:
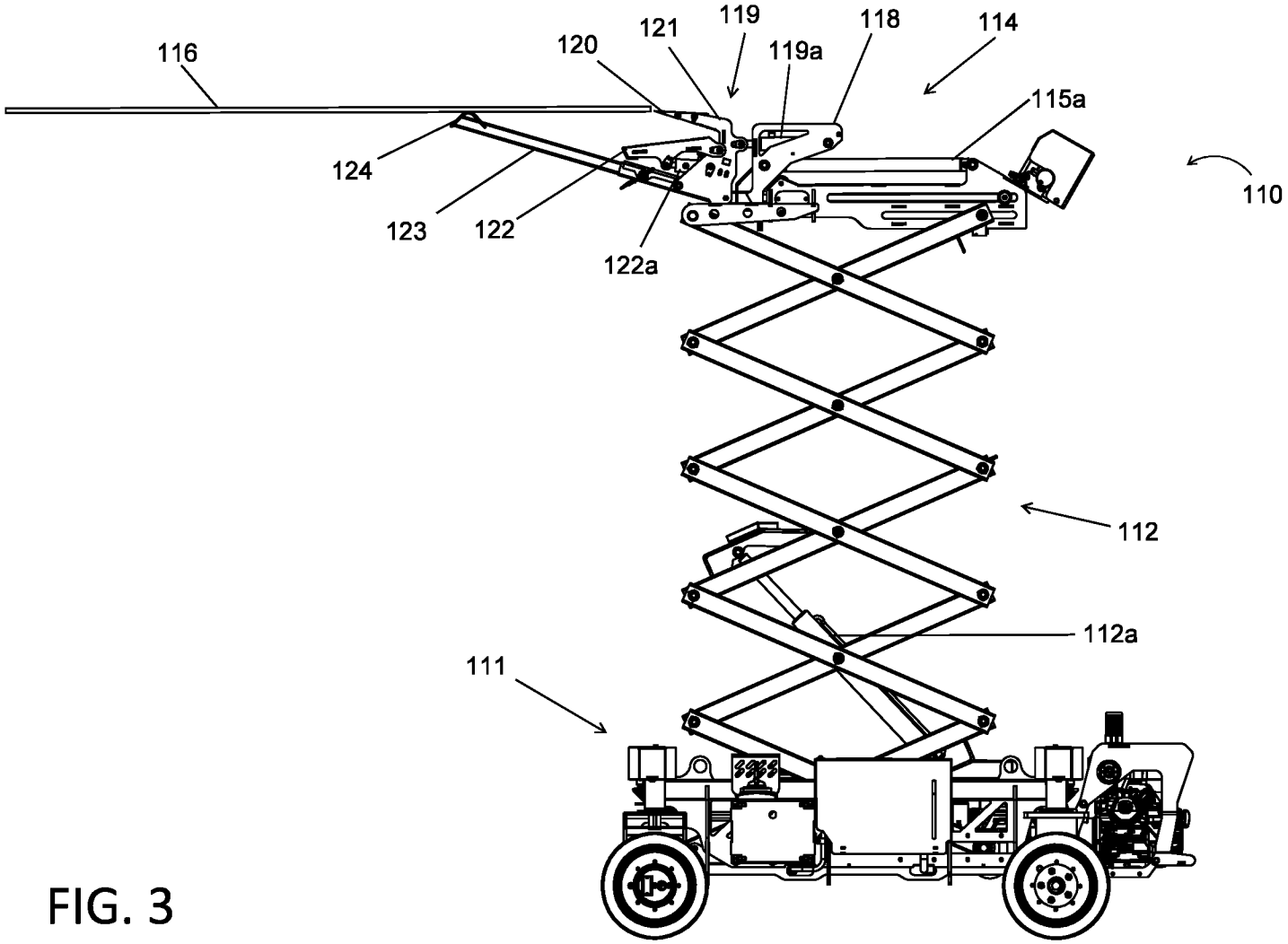
FIG. 3 is a side view of the formwork removing machine of FIGS. 1 and 2.
Figure 4:
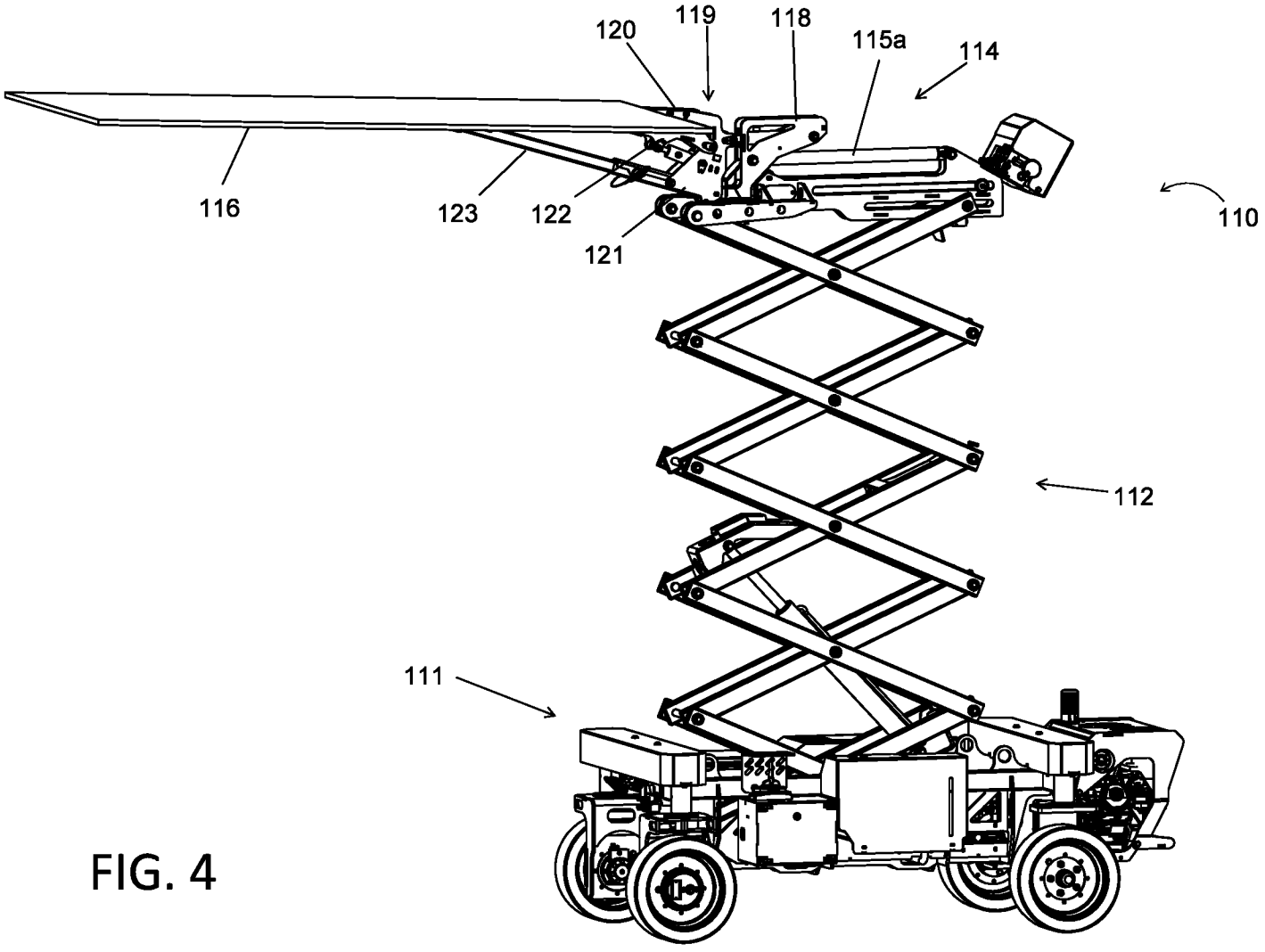
FIG. 4 is another perspective view of the formwork removing machine, shown with the grasping element in a closed state.
Figure 5:
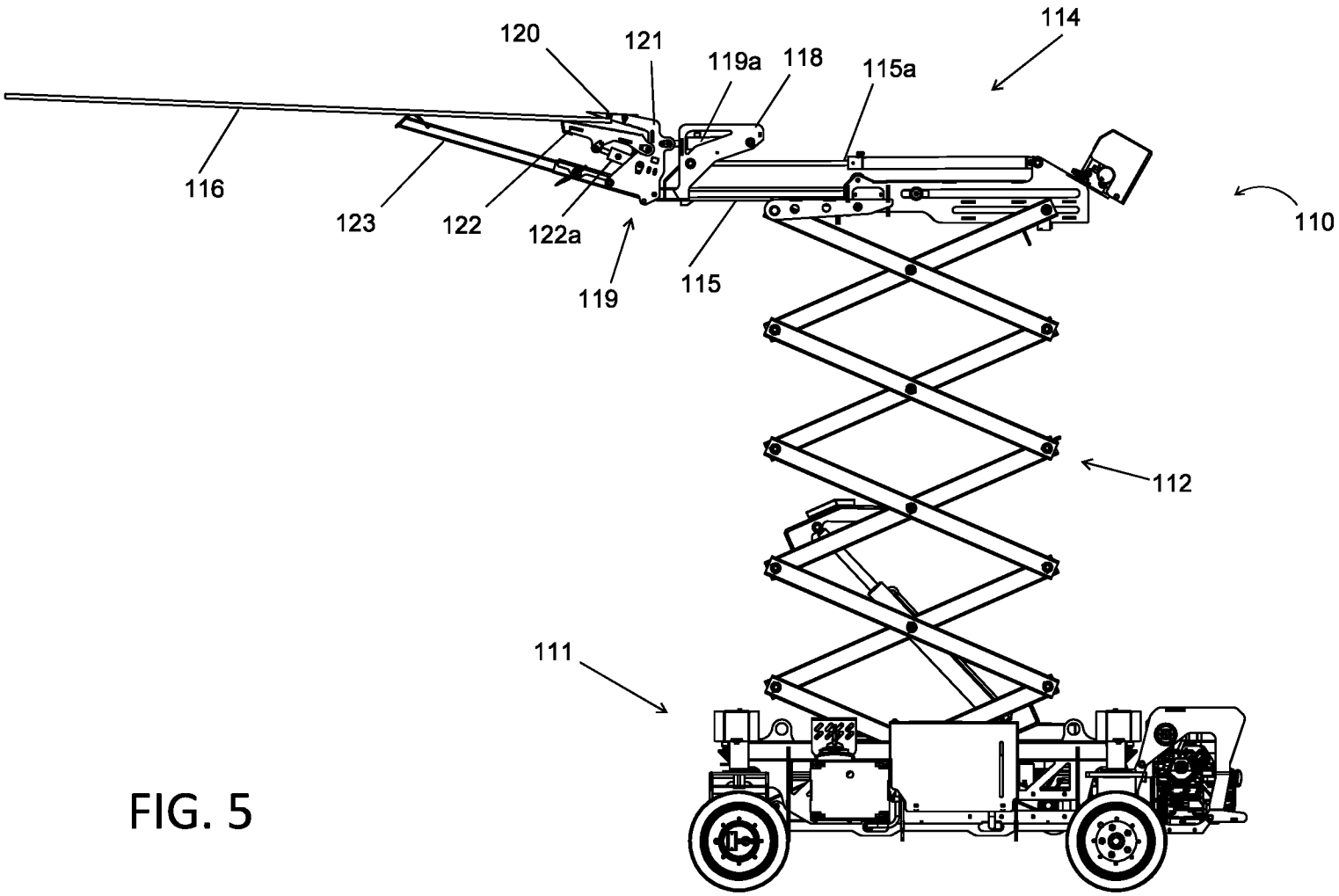
FIG. 5 is another side view of the formwork removing machine, shown with the boom in an extended position.
Figure 6:
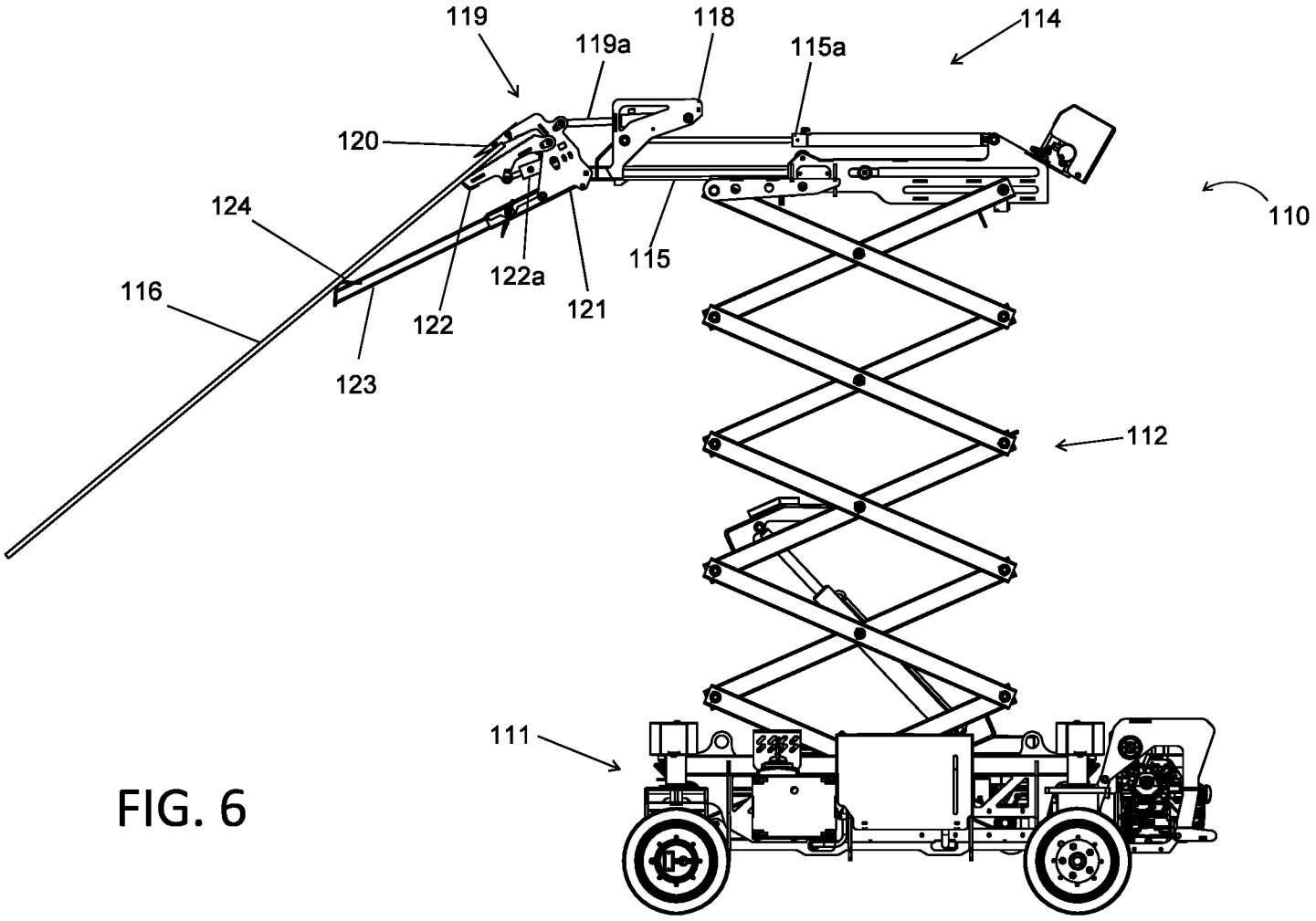
FIG. 6 is another side view of the formwork removing machine, shown with the boom in an extended position and the grasping device tilted downward relative to a support structure via a hydraulic actuator.
Figure 7:
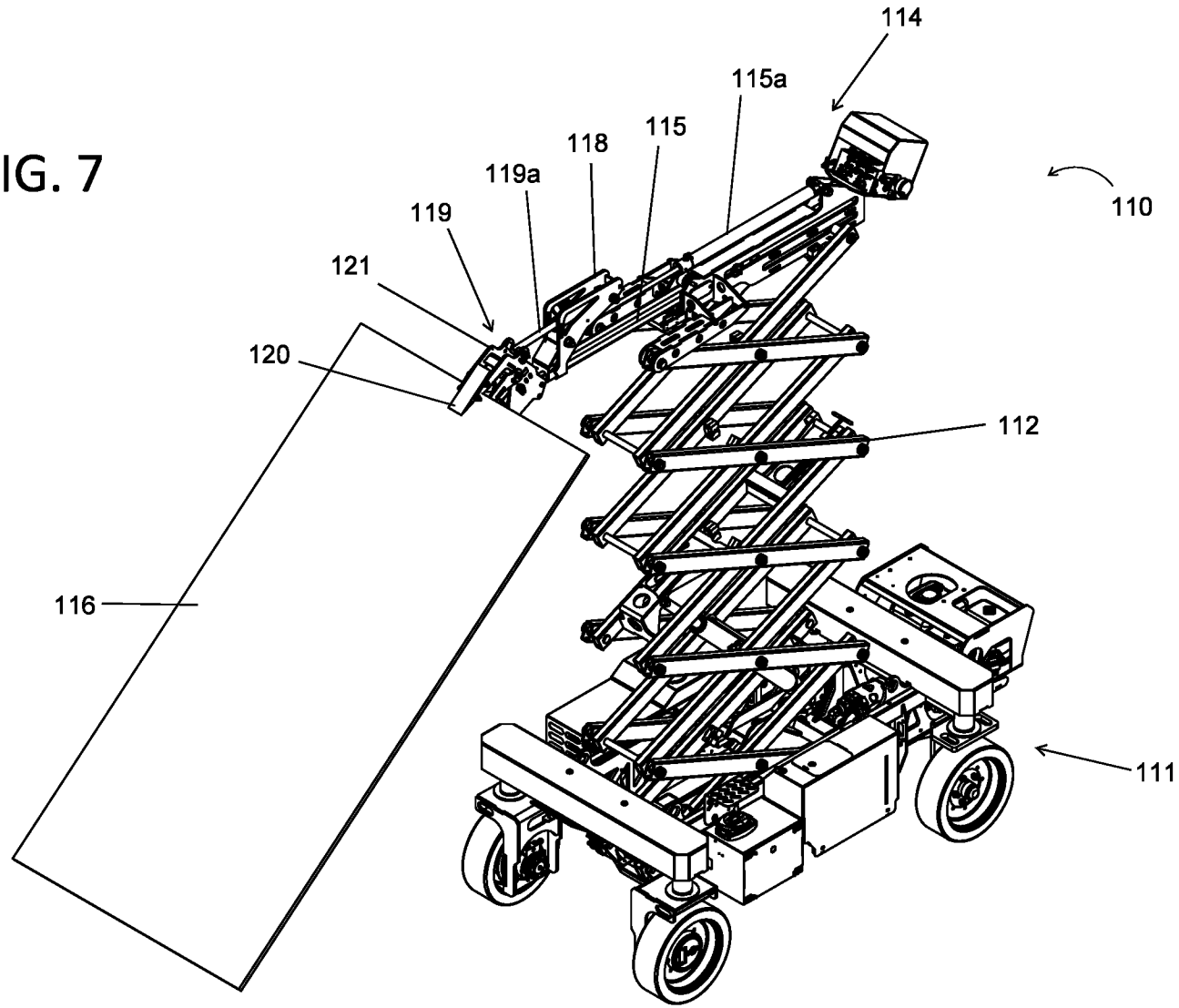
FIG. 7 is a perspective view of the formwork removing machine of FIG. 6.

As shown in FIGS. 5-7, the formwork-removal device 114 is mounted to the lift mechanism 112 at an extendable and retractable boom 115 that is extendable via actuation of an actuator 115*a*, such as, for example, a hydraulic cylinder or the like. The formwork-removal device 114 may also be mounted to the lift mechanism 112 directly or to a platform, structure, or otherwise coupled to the lift mechanism 112 opposite the base 111 such that when the lift mechanism is extended or raised from a retracted or lowered state to an extended or raised state, the formwork-removal device 114 is extended or raised away from the base 111.

Referring to FIGS. 8A-9B, the formwork-removal device 114 is configured to remove a piece of formwork, a beam, or a piece of plywood 116 from the underside of a hardened slab of concrete and to hold the removed piece of plywood 116. The formwork-removal device 114 comprises a support portion or structure 118 that is attached at the end of the boom 115, with a grasping device 119 pivotally mounted at the support portion 118 and/or at the end of the boom 115. The grasping device 119 is pivoted upward and downward via an actuator 119*a*, such as, for example, a hydraulic cylinder or the like. The grasping device 119 includes a support structure or base 121 that is pivotally mounted at the support structure 118, and includes a wedge element 120 or mechanism that extends from the support structure 121 for separating the formwork from the slab (in a manner to be described further below) and a grasping element 122 or mechanism or arm that cooperates with the wedge element 120 to grasp and hold the removed plywood 116.

Figure 8A:
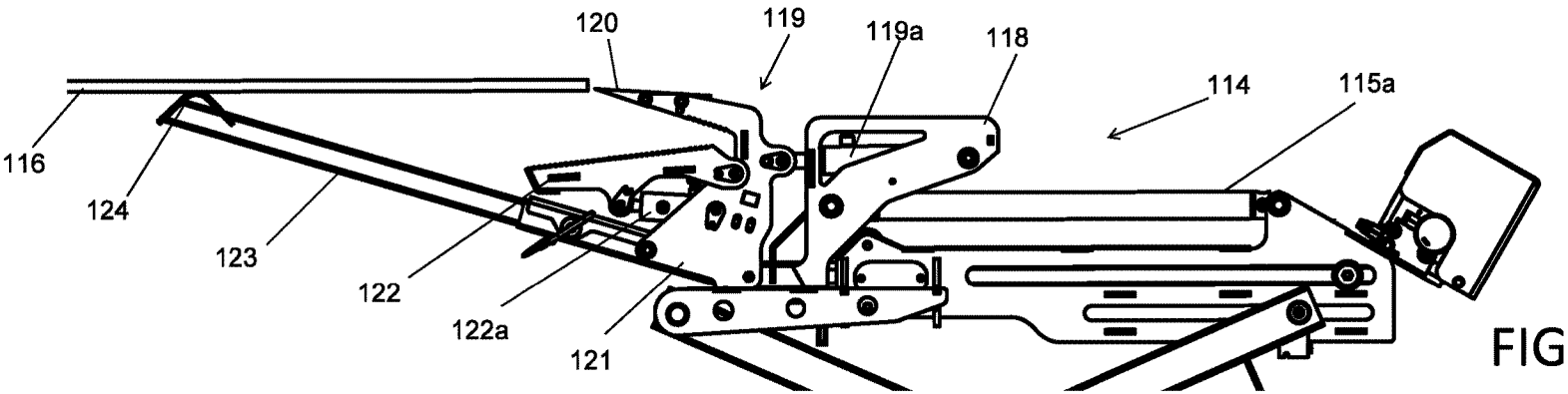
FIGS. 8A and 8B are enlarged partial side views of the formwork removing machine, shown with the grasping element in the opened state.
Figure 8B:
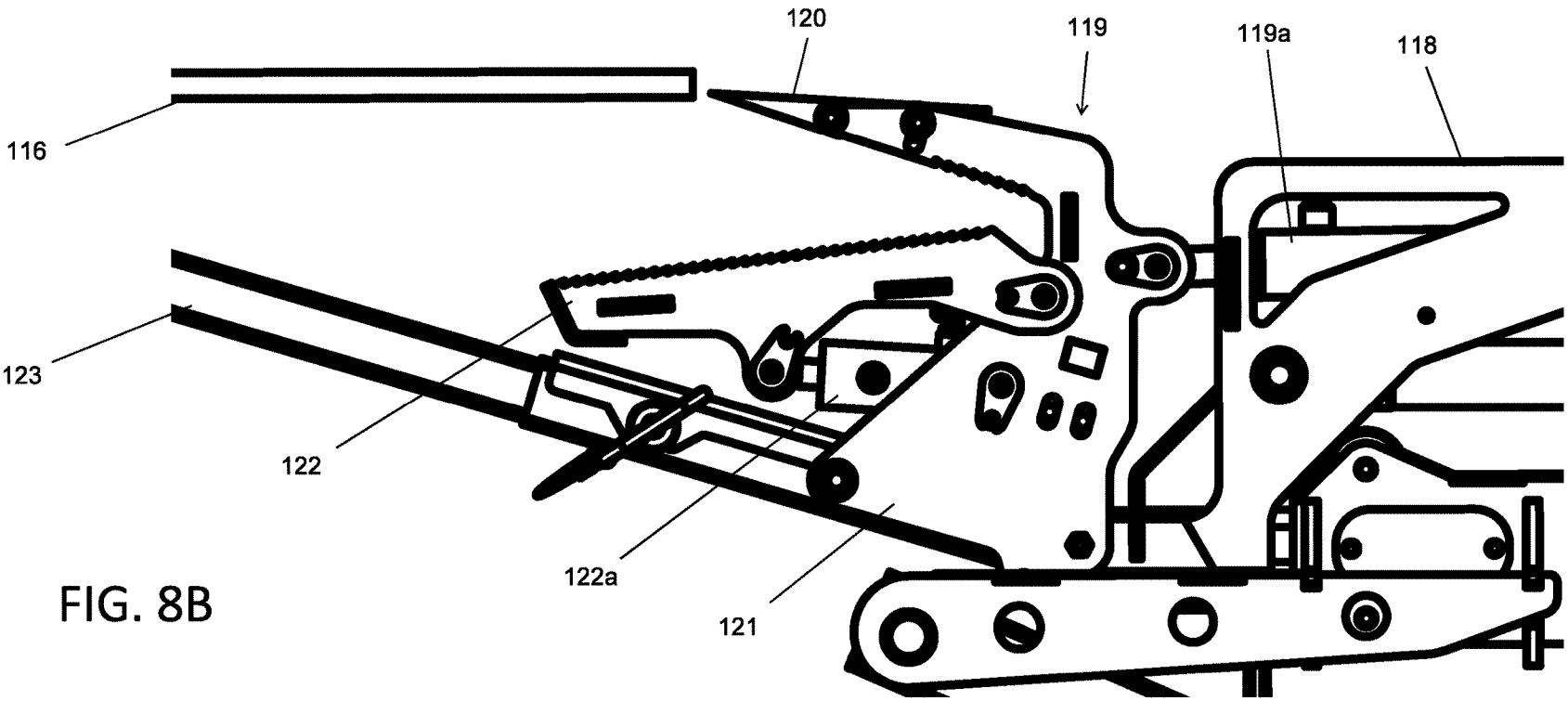
Figure 9A:
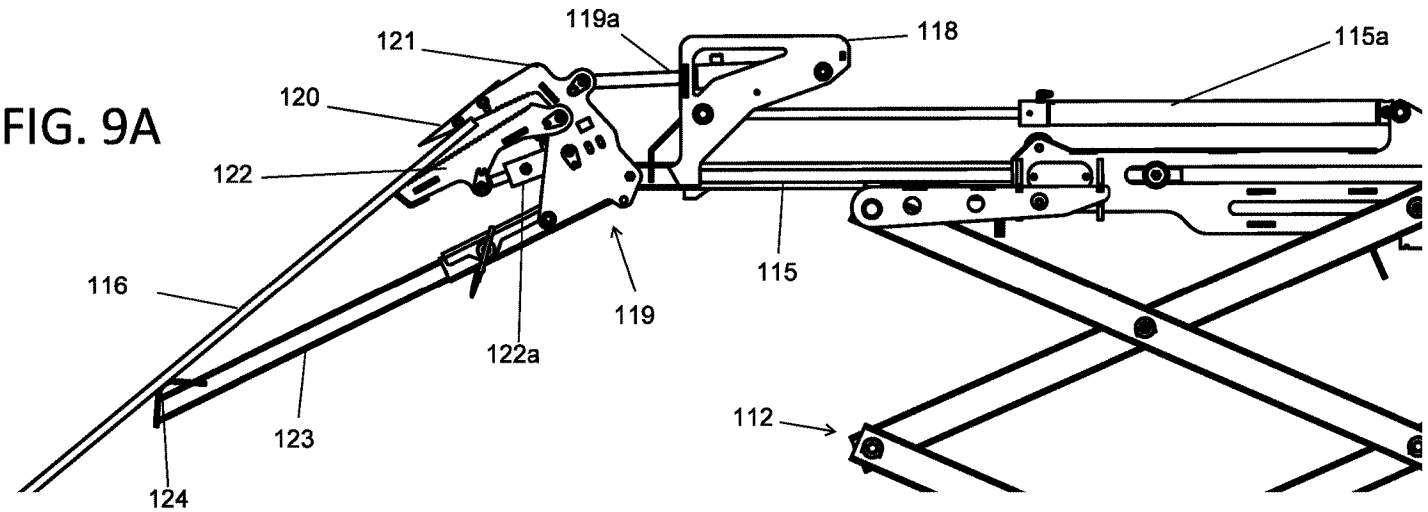
FIGS. 9A and 9B are enlarged partial side views of the formwork removing machine, shown with the boom in the extended position, the grasping element in the closed state, and the grasping device tilted downward relative to the support structure.
Figure 9B:
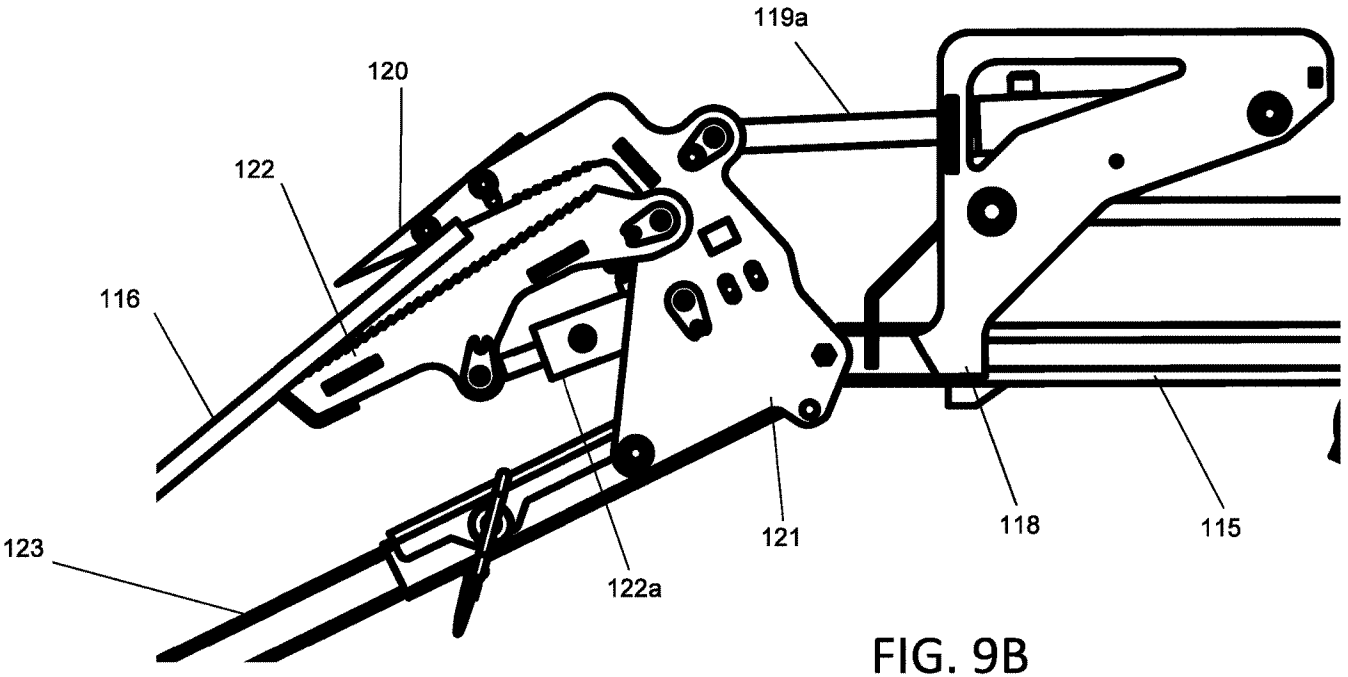

The grasping element 122 is pivotally mounted at the support structure 121 and is pivoted relative to the wedge element 120 between an opened state (FIGS. 8A and 8B) and a closed state (FIGS. 9A and 9B) via an actuator 122*a*, such as a hydraulic cylinder or the like. The grasping element 122 may be pivoted from an open state to a closed state such that the grasping element 122 engages the piece of plywood 116 between the grasping element 122 and the support structure 121 or wedge element 120, securing the plywood 116 in position. As best shown in FIGS. 8B and 9B, the opposing surfaces or edges of the grasping element 122 and the wedge mechanism 120 may be toothed or serrated or knurled or roughened or otherwise configured to enhance gripping of the plywood formwork 116 that is clamped between the grasping element 122 and the wedge mechanism 120.

Figure 10:
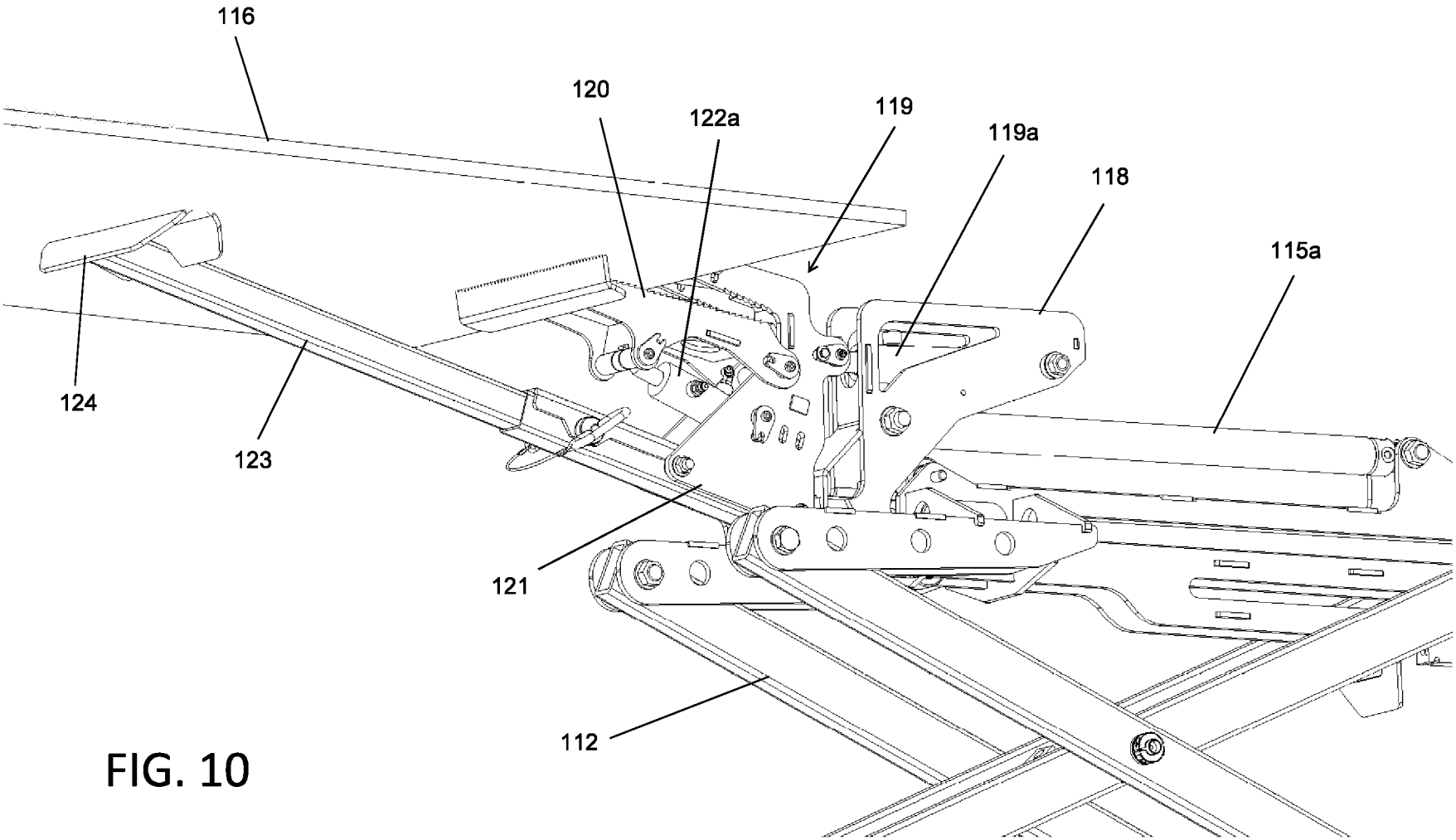
FIG. 10 is a partial perspective view of the formwork removing machine, shown with the grasping element in the closed state.
Figure 11:
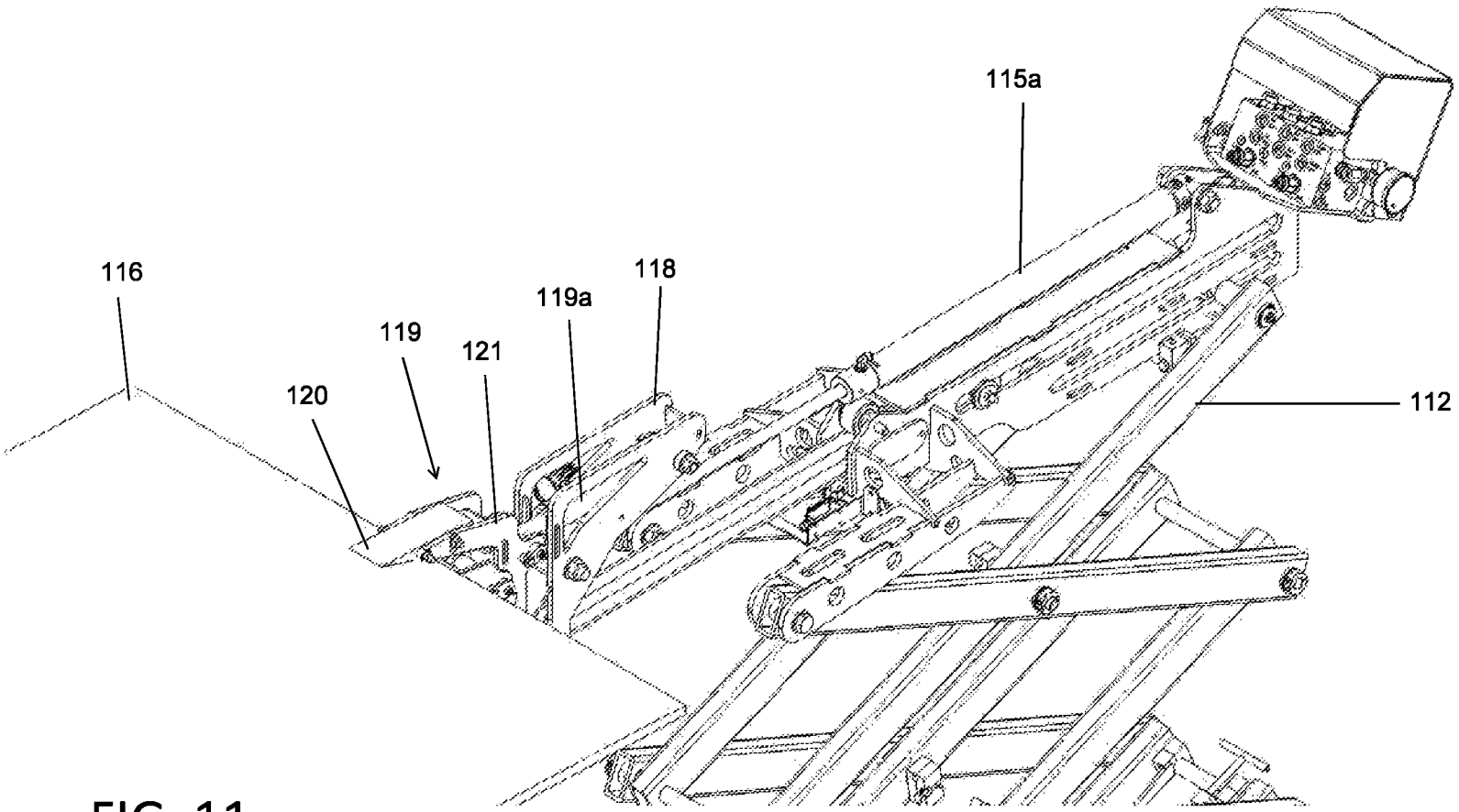
FIG. 11 is a partial perspective view of a formwork removing machine, shown with the boom in the extended position.
Figure 12:
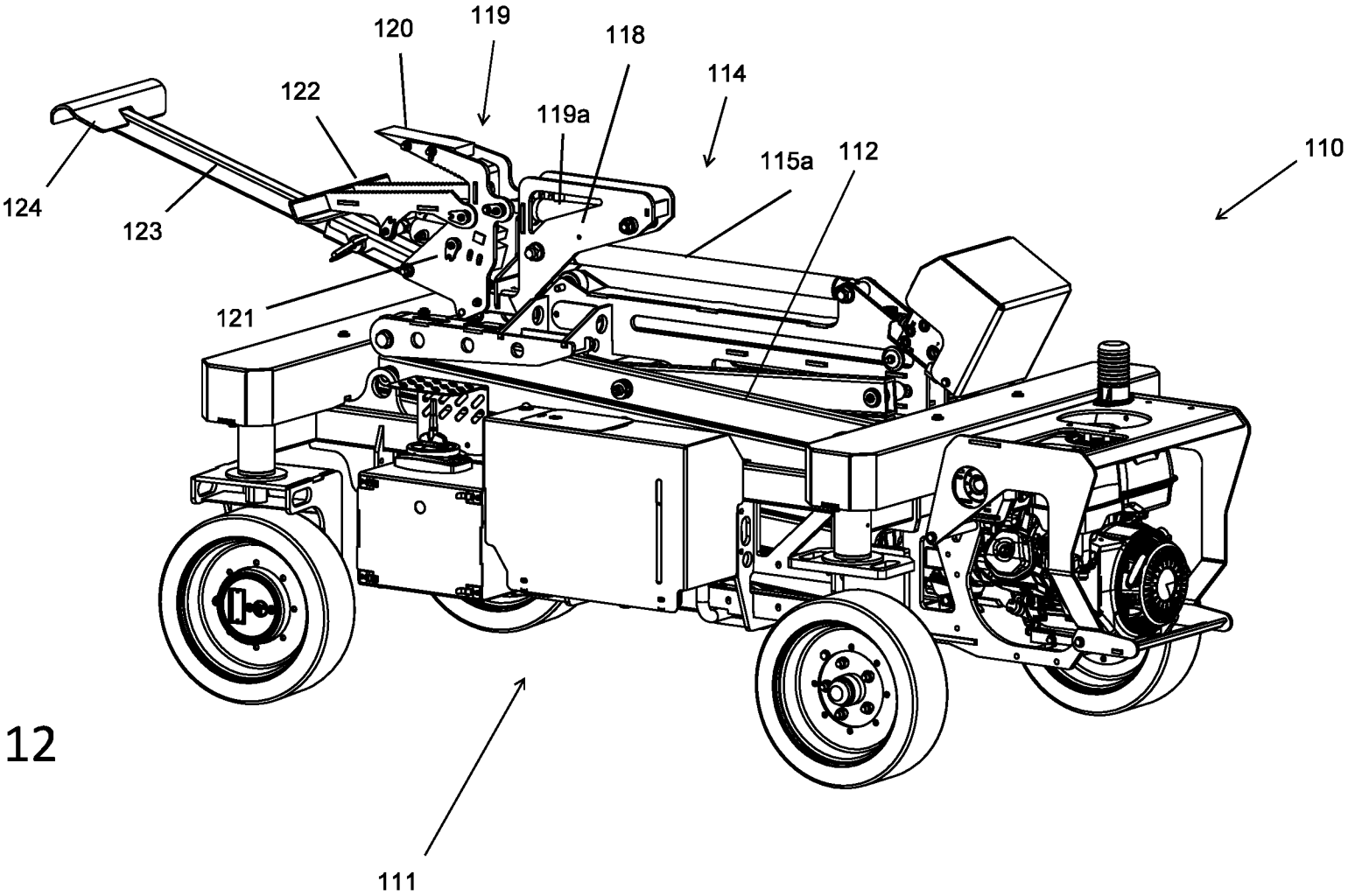
FIGS. 12 and 13 are perspective views of the formwork removing machine, shown with the lift structure retracted to a lowered or retracted position.
Figure 13:
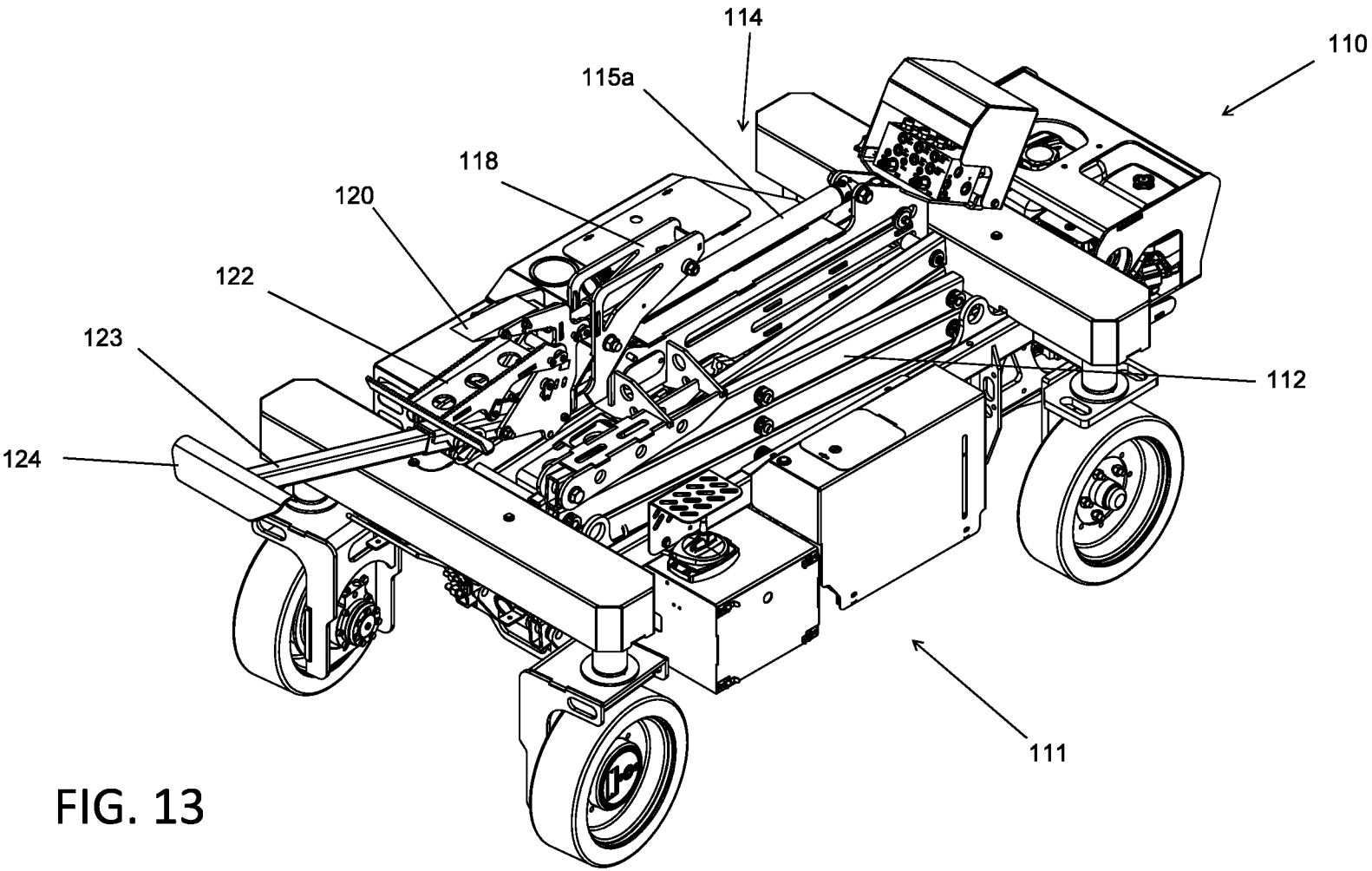
Figure 14:
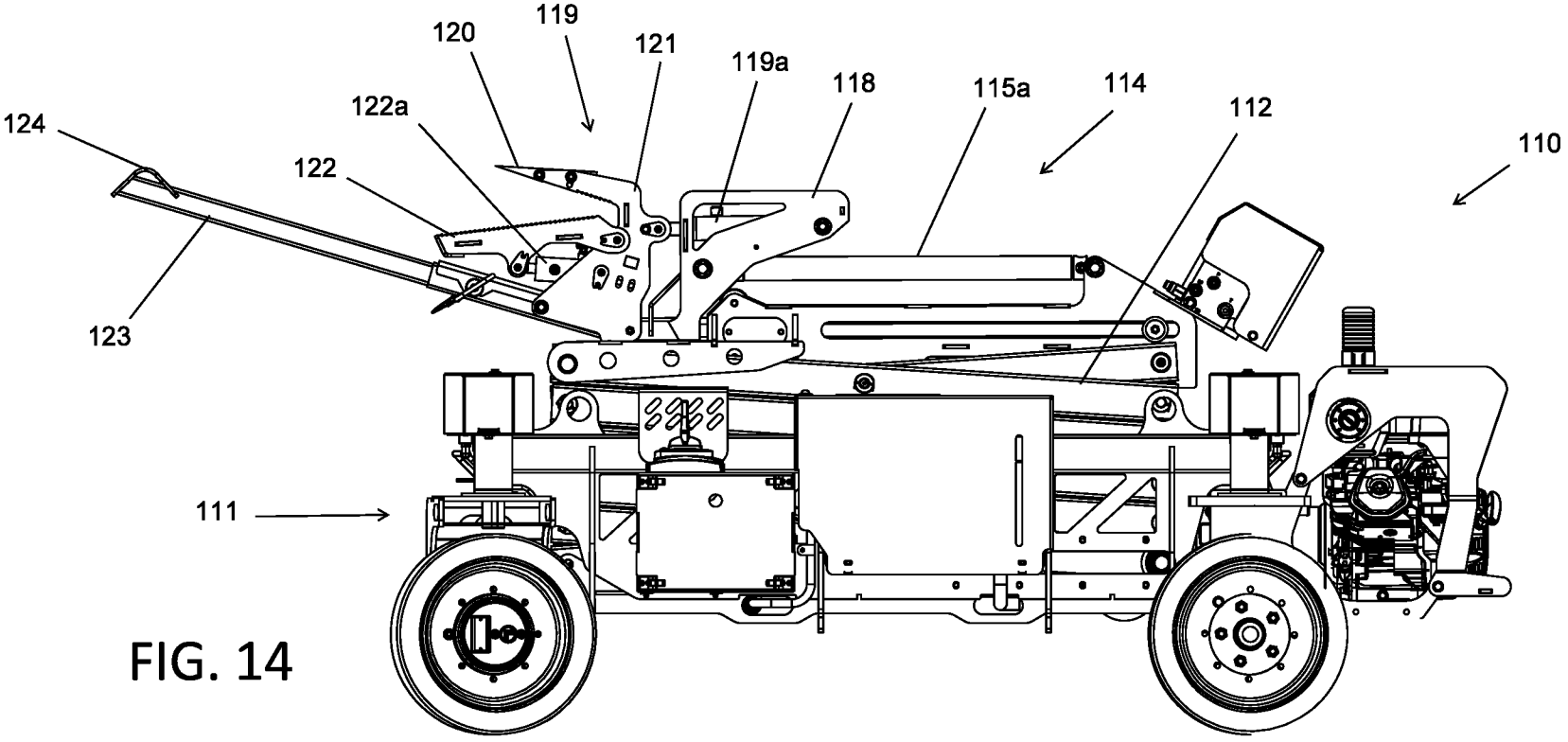
FIG. 14 is a side view of the formwork removing machine of FIGS. 12 and 13.
Figure 15:
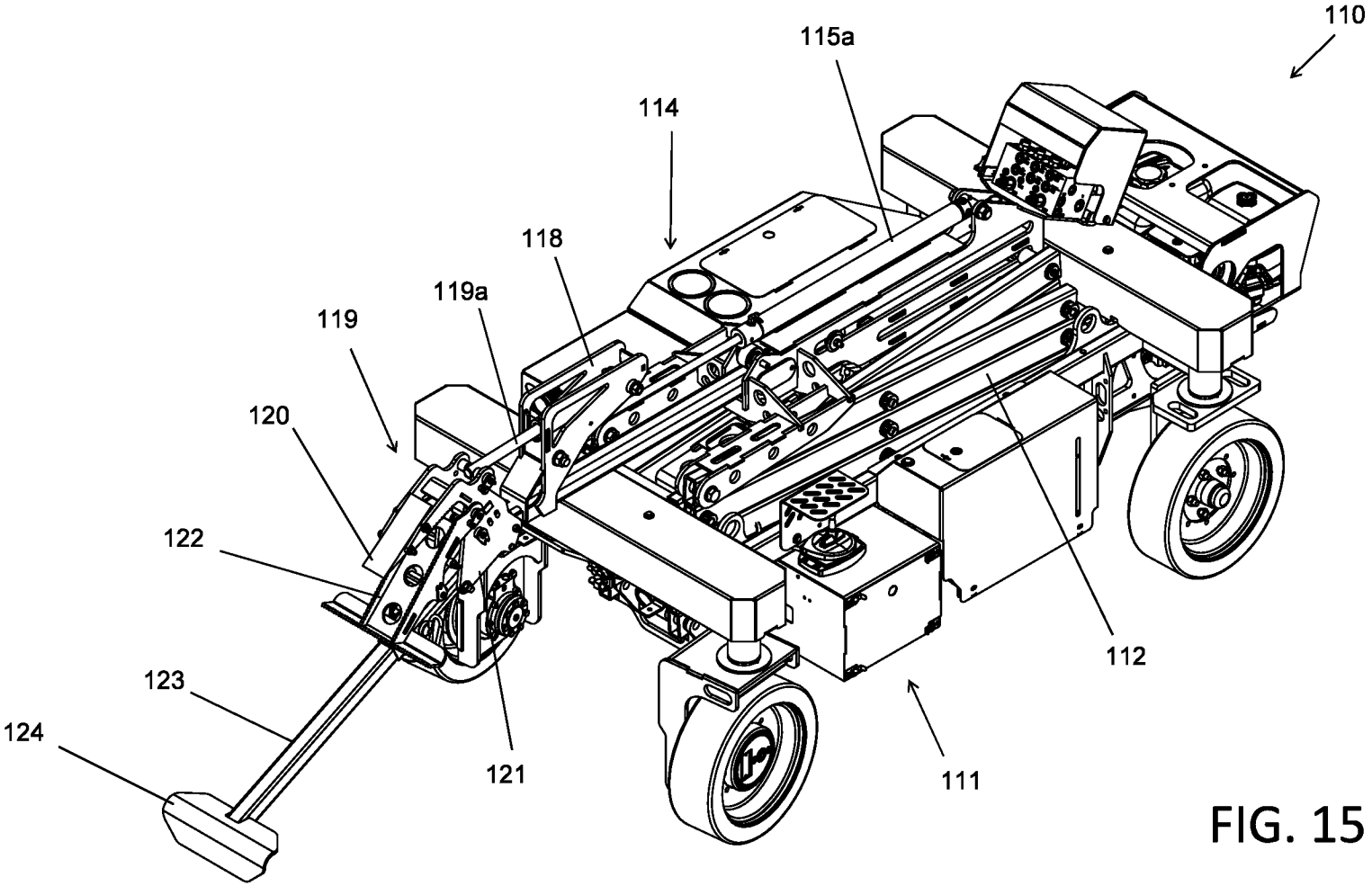
FIGS. 15 and 16 are perspective views of the formwork removing machine, shown with the boom in the extended position and the grasping device tilted downward relative to the support structure.
Figure 16:
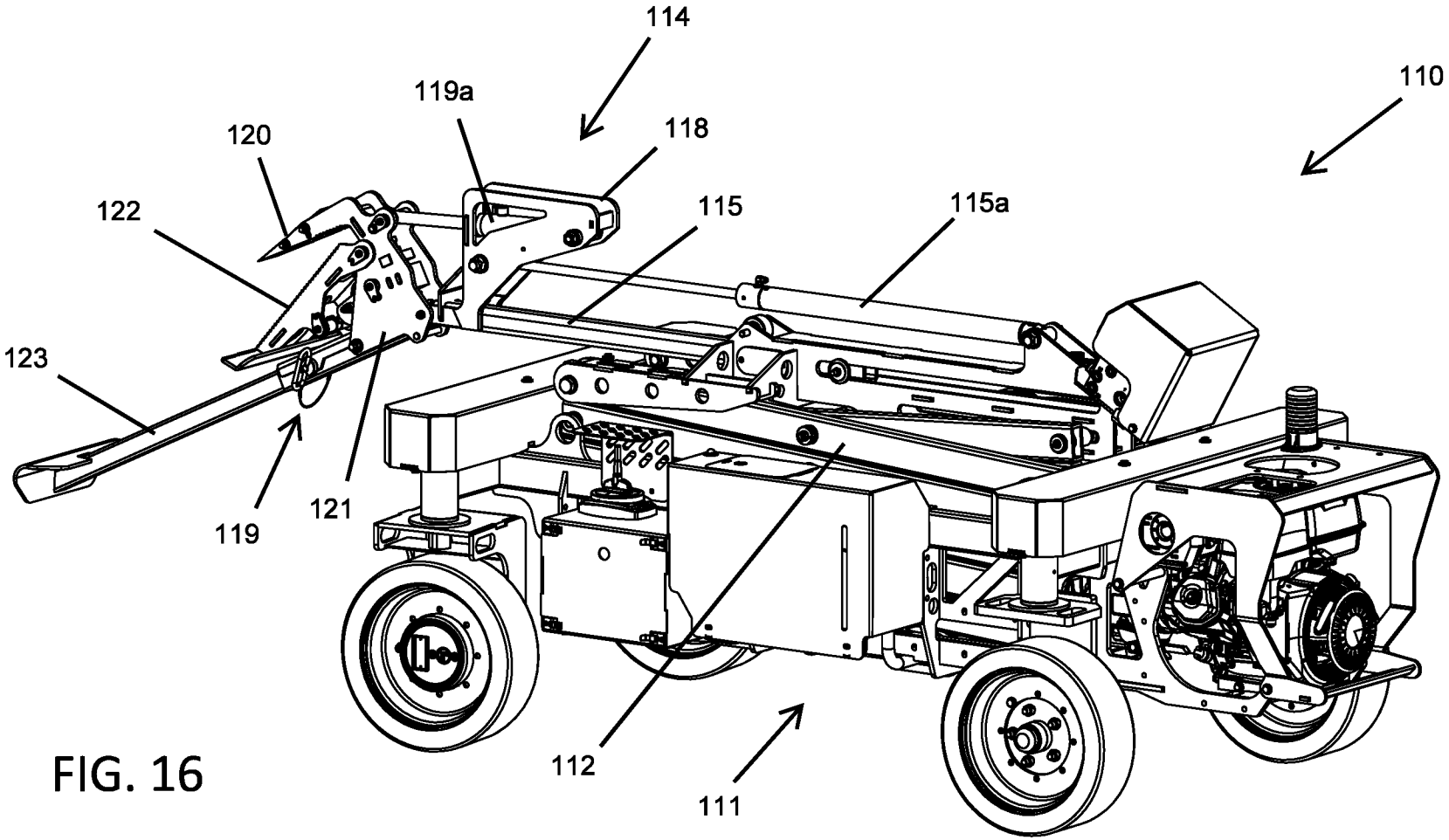
Figure 17:
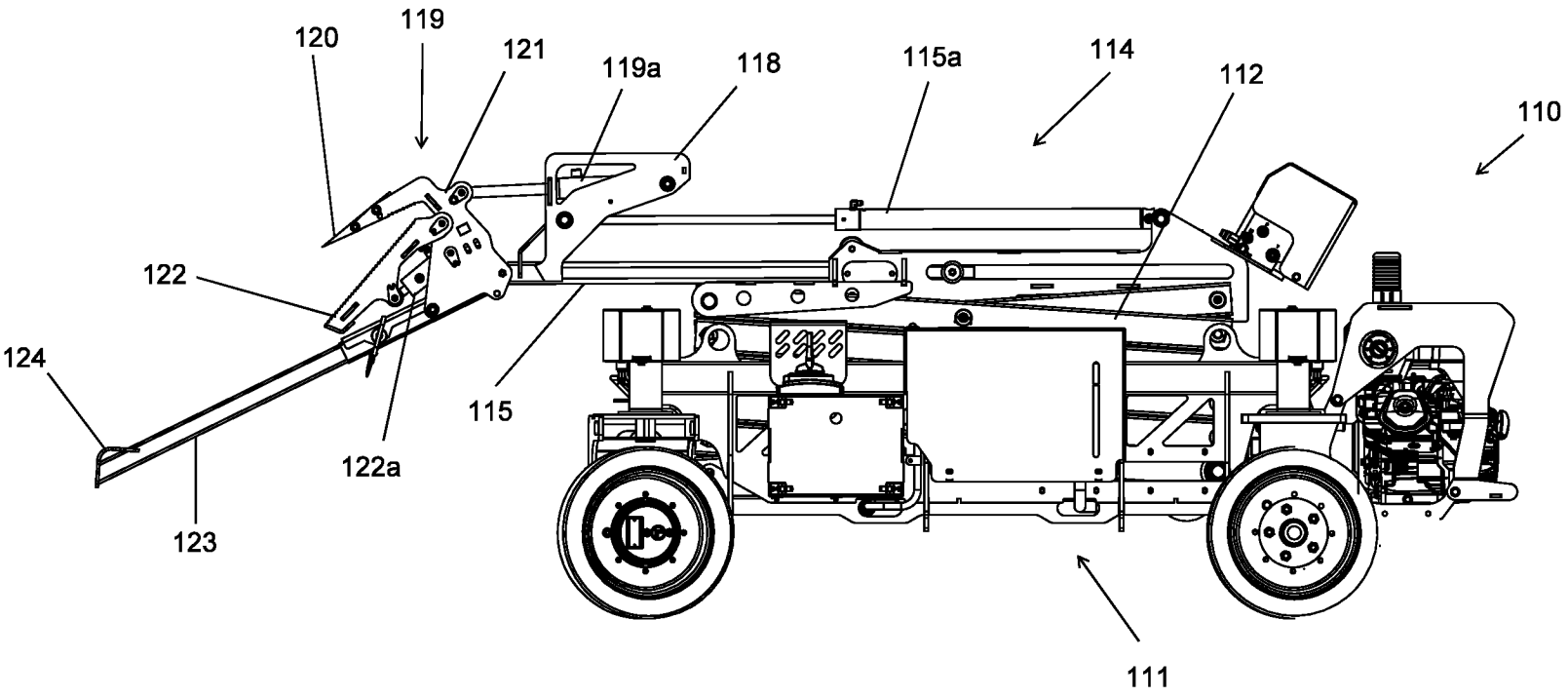
FIG. 17 is a side view of the formwork removing machine of FIGS. 15 and 16.

As shown in FIG. 10, the formwork-removal device 114 also includes a support arm 123 that extends from the grasping device 119 and pivots with the support structure 121 of the grasping device 119 when the grasping device 119 is pivoted upward and downward via the actuator 119*a*. The support arm 123 may be removably coupled to the support structure 121 and is configured to support the removed plywood 116 at a point distanced from where the plywood 116 is held between the grasping element 122 and the wedge element 120 or support structure 121. At a distal end from where the support arm 123 is coupled to the support structure 121, the support arm 123 may comprise a rounded cross support element 124 such that a removed piece of plywood 116 rests upon the rounded cross support 124 of the support arm 123. The rounded cross support 124 may comprise a folded disk or plate or bar substantially forming a cap over a distal end of the support arm 123 and extending horizontally from the support arm 123 so as to substantially form a T-shape. The rounded cross support 124 provides support to a piece of removed plywood 116 to prevent twisting or bending or breaking of the removed plywood 116 during removal of the plywood 116 or movement or raising or lowering of the formwork-removal device 110. The rounded cross support 124 also provides a rounded contact surface so as to reduce the chance of the formwork 116 catching or snagging or tearing or ripping upon an edge of the support arm 123.

Thus, the formwork-removal device 114 is operable to remove a piece of formwork 116 from the underside of a slab of hardened concrete. For example, the formwork removing machine 110 may be positioned substantially underneath a piece of plywood formwork 116 connected to a hardened concrete slab (after the concrete slab has been placed on the plywood and has sufficiently cured and hardened). The lift structure 112 may raise the formwork-removal device 114 to a targeted height to engage the plywood 116, whereby the actuator 119*a* moves the grasping device 119 and pivots the grasping device 119 upward to engage the wedge element 120 with the piece of plywood formwork 116, with the support arm 123 positioned at the formwork 116 with its distal support end spaced from the wedge element 120.

When positioned with the wedge element 120 at the formwork, the grasping device 119 may be extended to move the wedge element 120 to dislodge the formwork. For example, the boom actuator 115*a* may extend the boom 115 to apply a force upon the plywood 116 at the wedge element 120, whereby the grasping element 122 is pivoted to grasp or clamp the formwork 116 between the grasping element 122 and the underside of the wedge element 120 or support structure 121, with the support arm 123 supporting a distal portion of the formwork 116. The device 114 (while holding the removed formwork) may be lowered via the lowering of the lift structure 112 and the grasping device 119 may be pivoted downward (such as in FIGS. 6 and 7) relative to the support structure 118 at the end of the boom 115 and the grasping element 122 may be pivoted to its opened position to release and drop the removed formwork 116.

Referring to FIGS. 20-24, an additional embodiment of the formwork removing machine 210 for removing formwork panels and beams is provided. The formwork removing machine 210 may include similar aspects and functions of the formwork removing machines discussed throughout this disclosure such that a complete description of aspects of the machines need not be repeated herein. It should be understood that the multiple possible embodiments of the formwork removing machine may include or exclude elements contained within one or any combination of the illustrated embodiments provided by this disclosure. The formwork removing machine 210 includes a wheeled, motorized base 211. The base 211 has four independently powered wheels, each of which may be steered by pivoting around independent vertical axes. Optionally, the front wheels and/or the rear wheels may be steered in tandem by, for example, connecting the front wheels and/or the rear wheels via axles. Optionally, other wheel configurations may be used, such as, for example, a three-wheeled base or a base having more than four wheels, or a base propelled by tracks driven by rotationally driven wheels. The formwork removing machine 210 includes a raisable structure 212 disposed at the wheeled base 211, with a formwork-removal apparatus or device 214 attached at the raisable structure 212 for removing formwork and/or beams.

Figure 20:
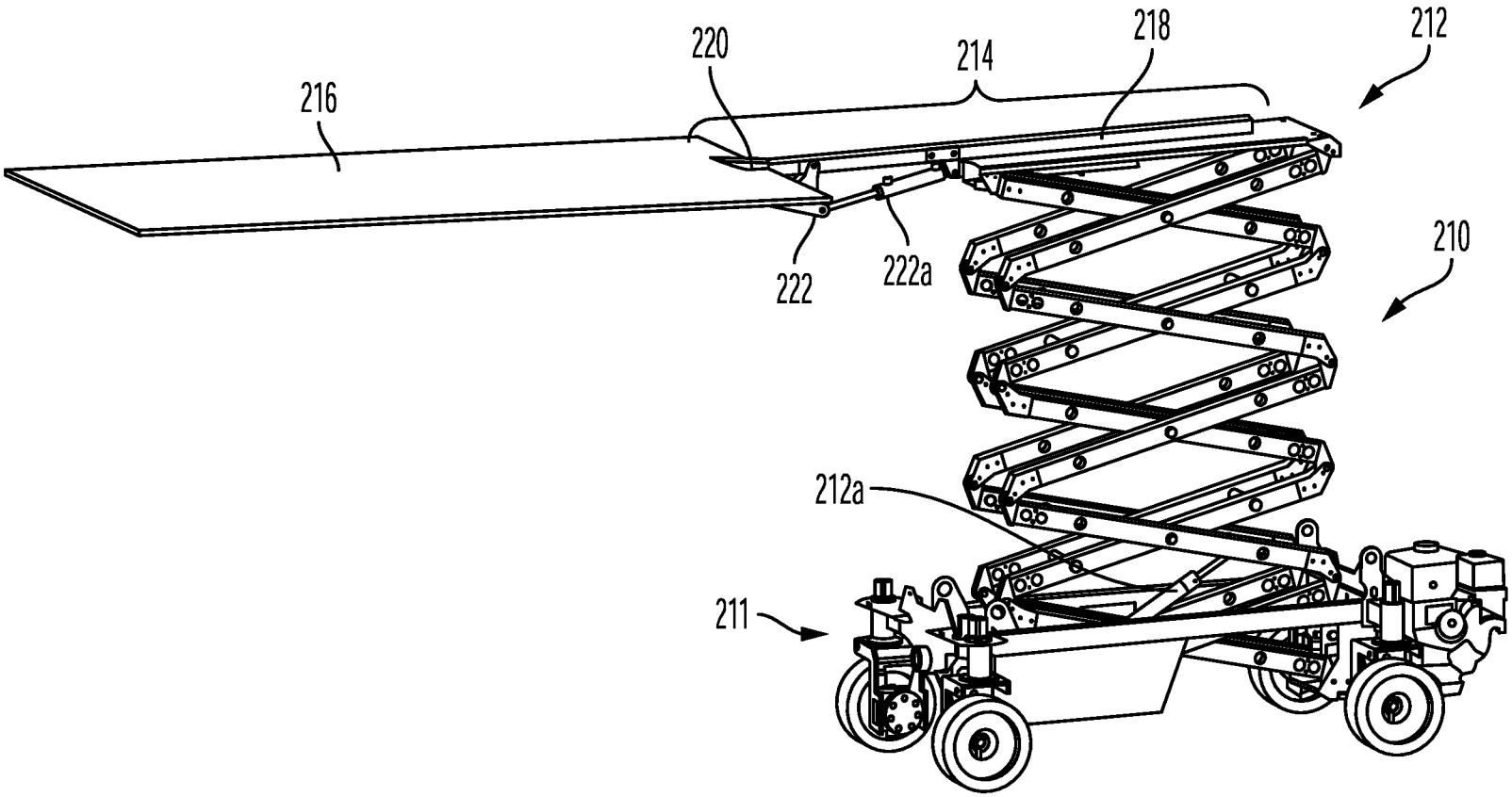
FIGS. 20 and 21 are perspective views of another formwork removing machine for removing plywood formwork, shown with its lift structure extended to a raised or extended position.
Figure 21:
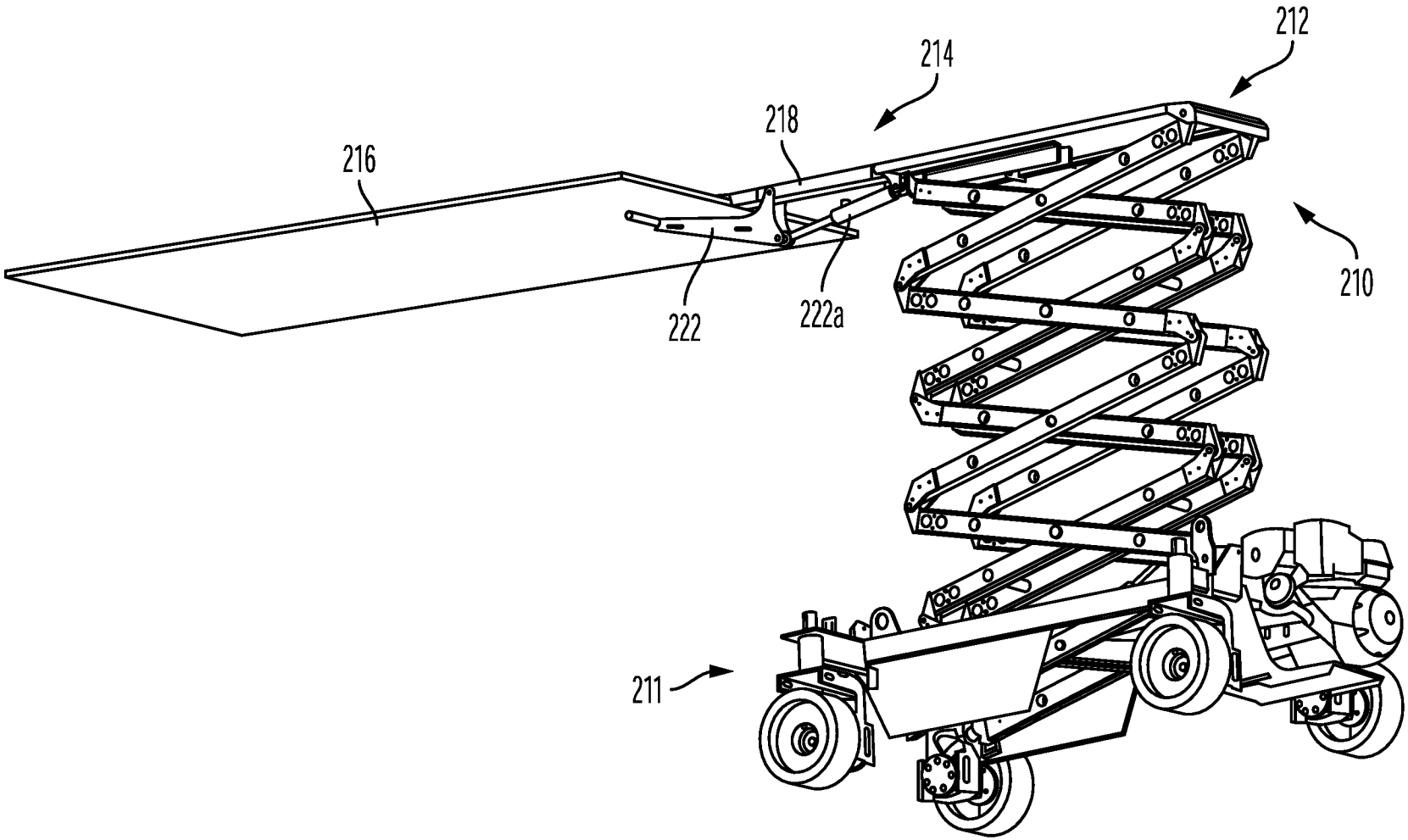
Figure 22:
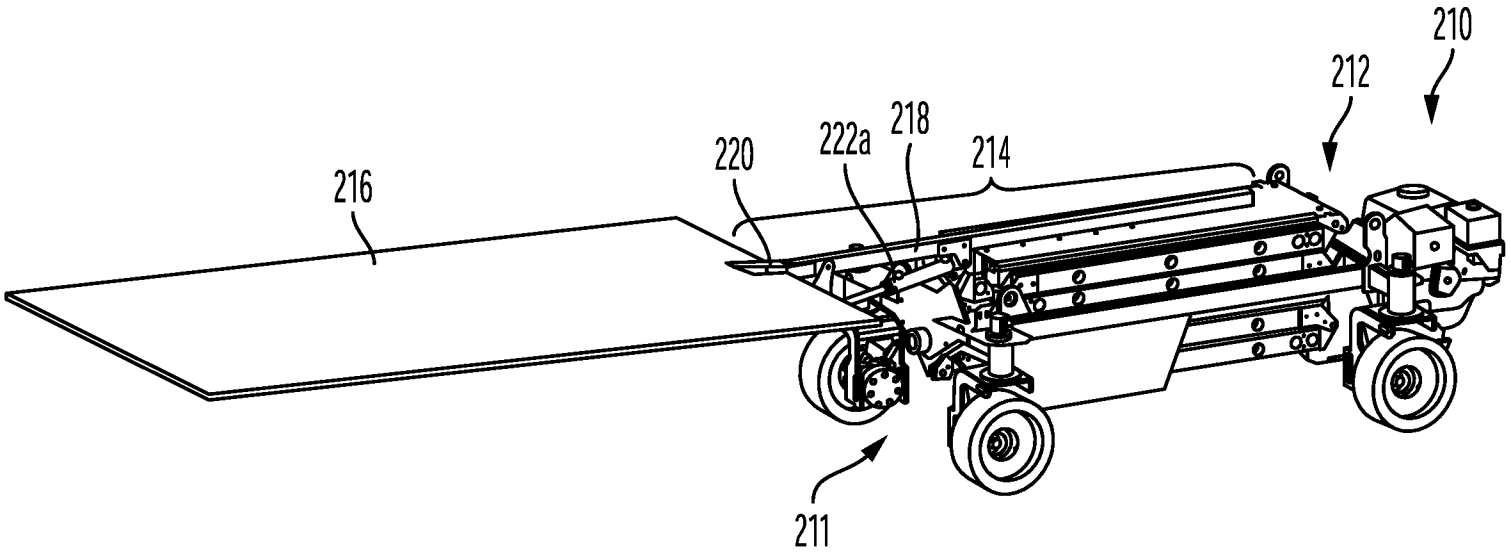
FIG. 22 is a perspective view of the formwork removing machine of FIGS. 20 and 21, shown with a lift structure retracted to a lowered or retracted position.
Figure 23:
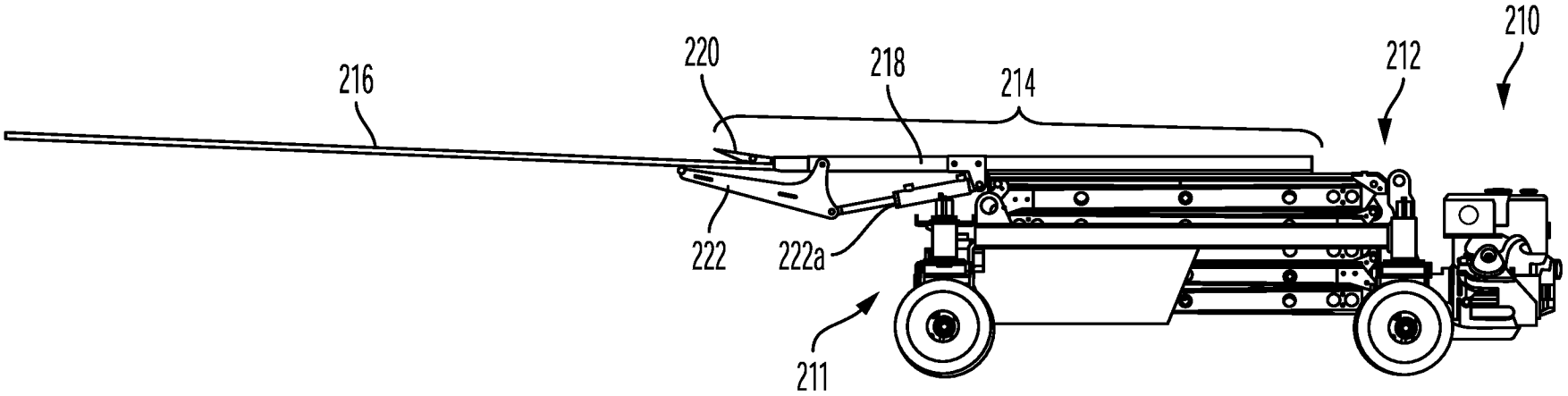
FIG. 23 is a side view of the formwork removing machine of FIG. 22.
Figure 24:
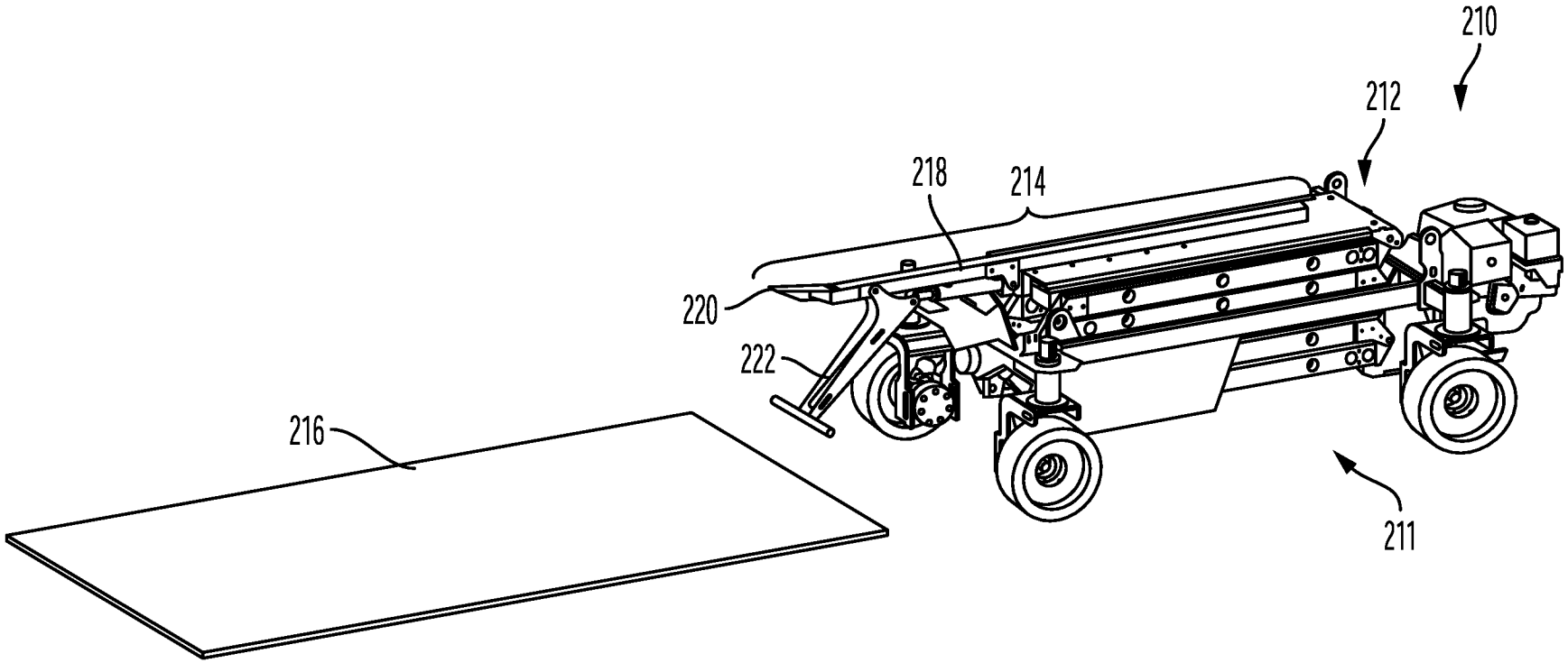
FIG. 24 is a perspective view of the formwork removing machine of FIGS. 22 and 23, shown with a grasping device in an opened state and a piece of plywood formwork resting on a ground surface.

In the illustrated embodiment, the raisable structure 212, similar to lift structure 112, comprises a scissor lift having a plurality of pivotally connected sections that pivot relative to one another to raise and lower the structure via extension and retraction of a hydraulic cylinder 212*a* at the base 211. The scissor lift, when extended or raised, such as shown in FIGS. 20 and 21, lifts or moves the formwork-removal device 214 to position it at the formwork or plywood 216 for removal of the formwork from the underside of the slab. The scissor lift, when retracted, such as shown in FIGS. 22-24, folds into a compact configuration on the wheeled base 211, with the formwork-removal device 214 lowered down to the lowered or retracted state.

Figure 25:
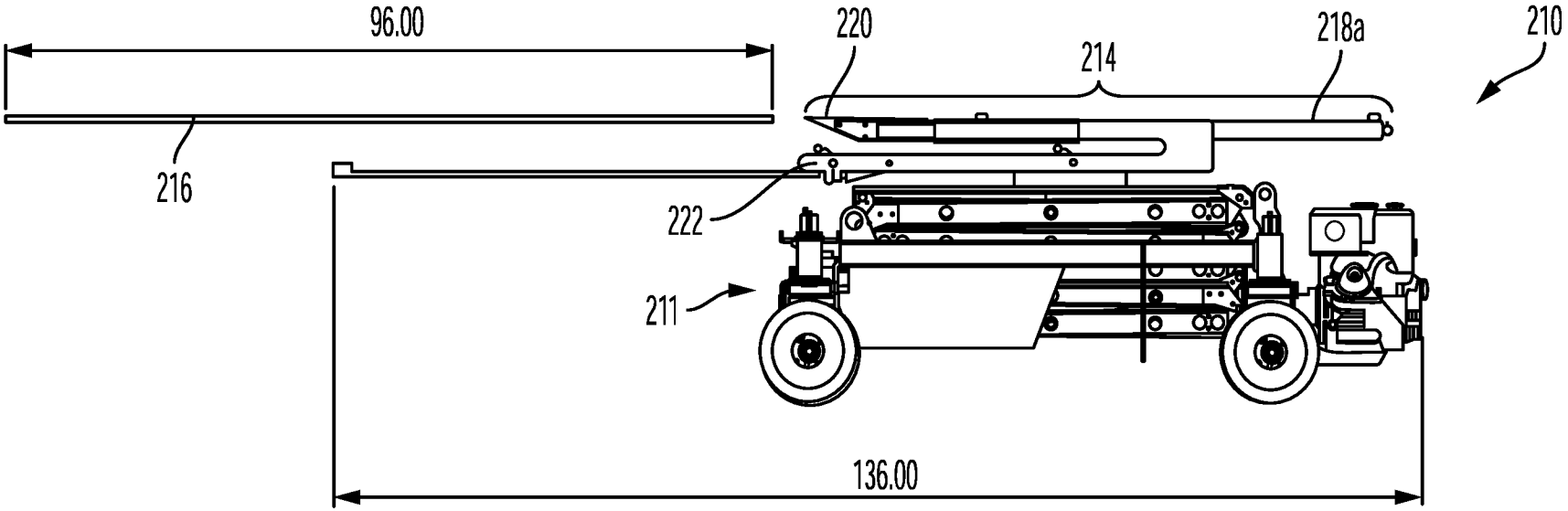
FIG. 25 is a side view of another formwork removing machine for removing plywood formwork, shown with a boom for extending a wedge element relative to the lift structure.
Figure 26A:
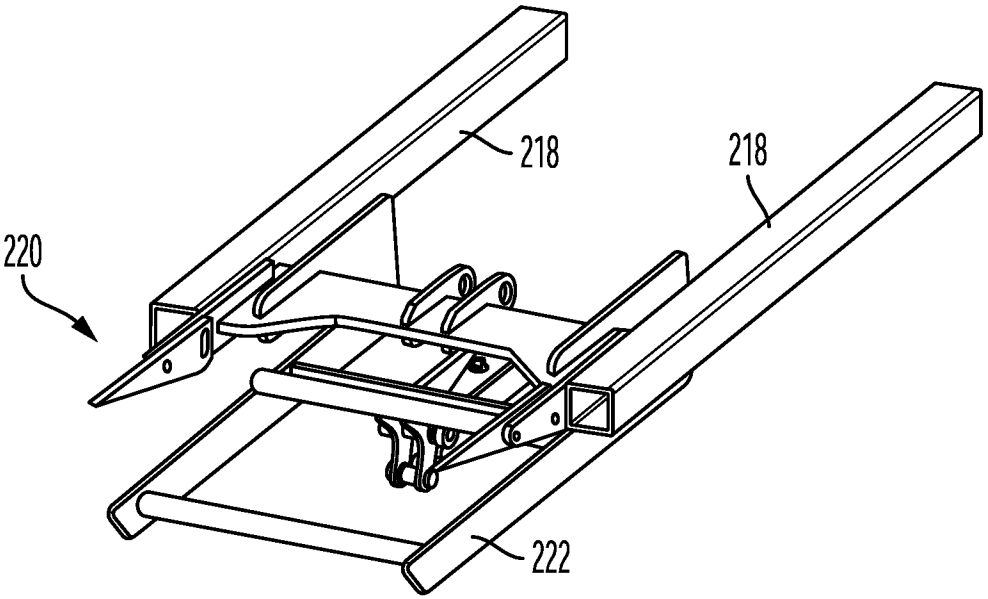
FIGS. 26A and 26B are partial perspective and side views of a dual-wedge mechanism and receiving and retaining mechanism of a formwork removing machine.
Figure 26B:
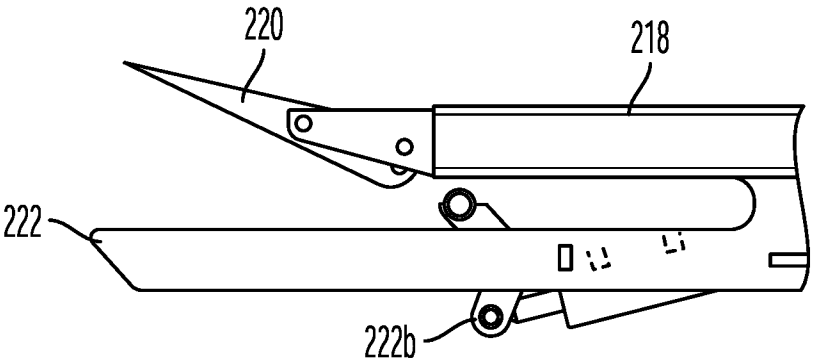

As shown in FIGS. 20-23, the formwork-removal device 214 is configured to hold a piece of plywood formwork 216 that the machine 210 may have removed from the bottom of a hardened slab of concrete at a height near a raised/extended position of the raisable structure 212. The formwork-removal device 214 includes an arm 218, a wedge mechanism 220 for separating the plywood 216 from the slab, and a retaining mechanism 222 to hold the removed plywood 216. The wedge mechanism 220 is located at the leading end of the arm 218, distal from where the arm 218 attaches at the raisable structure 212 so that as the machine 210, with the raisable structure extended or raised to position the wedge mechanism 220 at the plywood 216 and concrete, moves forward, the wedge mechanism 220 engages with the plywood 216 and is urged between the plywood and the concrete slab, applying a force to separate the plywood 216 from the concrete slab. Optionally, the arm 218 may be extendable from the raisable structure 212 via a hydraulic actuator 218*a* or extendable boom or similarly capable mechanism, as shown in FIG. 25. The hydraulic actuator 218*a* may enable the wedge mechanism 220 to extend greater distances from the raisable structure 212. The hydraulic actuator 218*a* may also enable the wedge mechanism 220 (when raised so that the wedge element 220 is at the plywood 216 and underside of the slab) to engage the plywood 216 and move between the plywood and concrete slab as the hydraulic actuator 218*a* extends forward, while the wheeled base 211 remains stationary such that the extending motion of the hydraulic actuator 218*a*, rather than the motion of the wheeled base 211, primarily creates the separating force applied upon the plywood 216 attached at the underside of the concrete slab.

When the wedge mechanism 220 has been moved and positioned a sufficient amount into the interface between the plywood 216 and concrete slab, the retaining mechanism 222 operates to clamp or grasp the plywood 216 for removing the plywood 216 from the concrete slab and moving the plywood 216 to a targeted location. The retaining mechanism 222 may include a hydraulically activated jaw that supports and holds the plywood 216 after removal from the slab. For example, and such as best seen in FIGS. 21-23, the retaining mechanism 222 includes a hydraulic actuator 222*a* (or other suitable actuating device) that is extended to pivot a plywood engaging element into engagement with the plywood 216 to clamp the plywood 216 between the plywood engaging element and the arm 218. When the plywood is clamped in this manner, the formwork-removal device 214 may be lowered via lowering of the raisable structure 212 to pull the plywood downward and to further and fully remove the plywood 216 from the concrete slab.

Thus, the plywood 216 may be carefully lowered from the height of the slab to a suitable or targeted storage location. For example, and such as shown in FIGS. 22 and 23, the machine 210 may lower the plywood 216 to a point near the ground surface by retracting the raisable platform 212 to a lowered position while the formwork-removal device 214 continues to securely hold the plywood 216. As shown in FIG. 24, the machine 210 may open the retaining mechanism 222 by retracting the hydraulic actuator 222*a* to release the removed plywood 216 to rest on the ground surface.

Optionally, and such as shown in FIGS. 26A-27B, the formwork removing machine 210 may include a dual-wedge wedge mechanism 220 and a receiving and retaining mechanism 222. As shown, the wedge mechanism 220 includes a pair of wedges or wedge-shaped elements, each wedge located at one side of the leading or distal end of the arm 218, which may comprise a pair of spaced apart arms, one at each wedge, such that each wedge engages with the plywood 216 and underside of the slab or ceiling in parallel. Thus, the separating force may be more evenly distributed across the plywood 216, reducing possible damage to the plywood 216. Additional wedges may be used to further distribute the removal forces.

Figure 27A:
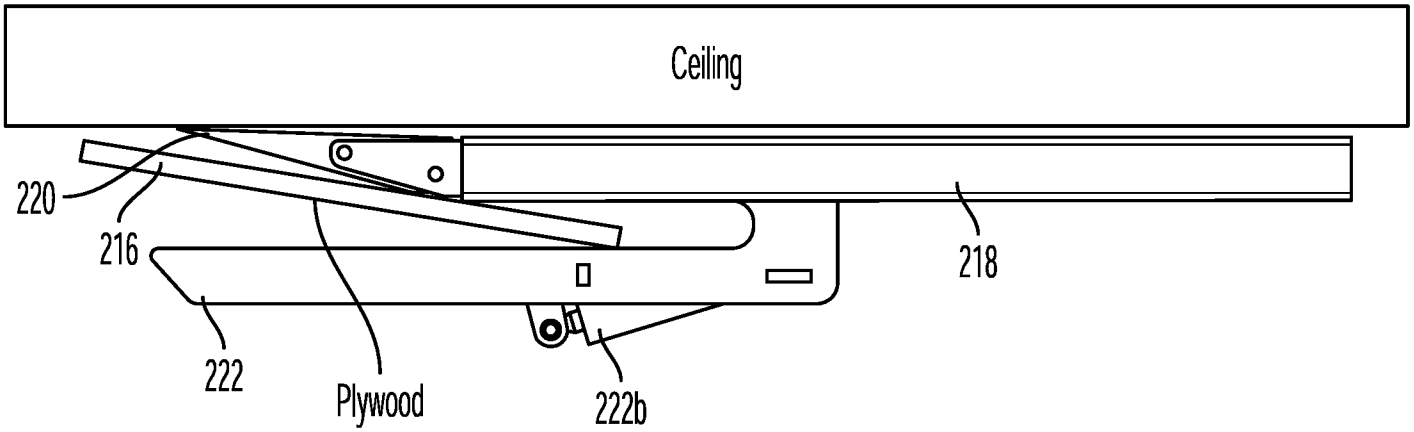
FIGS. 27A and 27B are side views of the dual-wedge mechanism of FIGS. 26A and 26B, shown in two stages of removing plywood formwork from a concrete ceiling structure.
Figure 27B:
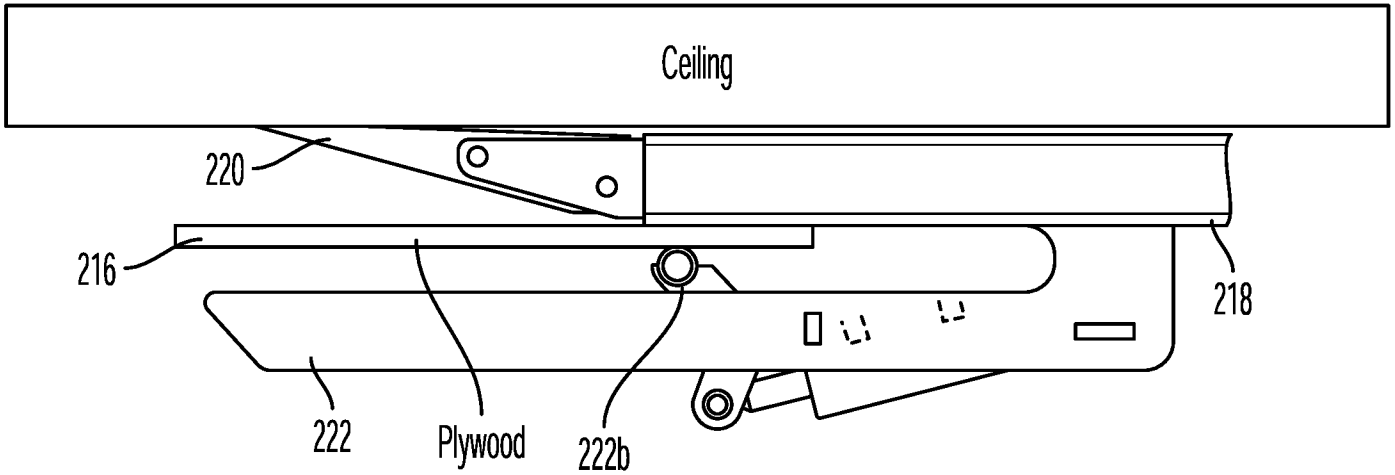

The receiving and retaining mechanism 222 includes a shelf or receiving structure located below the wedge mechanism 220 to receive removed or partially removed plywood 216, and a hydraulically activated clamping mechanism 222*b* to secure the removed plywood 216 at the receiving structure of the arm 218 and retaining mechanism 222, such as by clamping the plywood 216 against a portion of the arm 218 located above the shelf or against the lower part of the receiving structure 222. Each wedge of the wedge mechanism 220 is attached to the leading end of the arm 218 on a structure that allows the wedge to pivot on the structure to conform to the surface of the slab during removal of the plywood. Optionally, the center of gravity of the wedge may cause the wedge to pivot upwards and maintain contact with the bottom of the slab so that, as the wedge system 220 moves forward, the point of the wedge is forced between the slab and the formwork 216. Optionally, and as shown in FIGS. 27A and 27B, the wedge elements 220 may be biased via a torsional spring or other biasing means to pivot the wedges so that the tips of the wedge elements 220 point partially upward towards the ceiling or hardened concrete slab and formwork. The wedge elements 220 thus may be biased toward a position or orientation where they are readily forced between the plywood 216 and the underside of the concrete slab when the arm is moved toward the plywood 216.

As shown in FIG. 27A, during operation of the formwork removing machine, the wedge mechanism 220 is moved into engagement with the plywood 216 and the retaining concrete slab (illustrated as "Ceiling") such that the wedges may displace the plywood 216 from the concrete slab as the formwork removing machine moves the wedge mechanism 220 further into the area between the plywood 216 and the concrete slab, the wedges working to pry or separate part of the plywood 216 from the concrete slab. As shown in FIG. 27B, once the wedge mechanism 220 is positioned sufficiently far in and between the plywood 216 and the concrete slab, such that part of the plywood 216 is received in the receiving and retaining mechanism 222, the clamping mechanism 222*b* may be activated to engage the plywood 216. The clamping mechanism 222*b* may be activated, for example, by extending or retracting a hydraulic actuator connected to a clamp head, thereby pivoting the clamp head to engage and clamp the plywood 216 between the clamping mechanism 222*b* and a portion of the arm 218 or between the clamping mechanism 222*b* and the retaining mechanism 222. With the plywood 216 secured and clamped in the receiving and retaining mechanism 222, the formwork-removal device 214 may be lowered and moved, such as via lowering the extendable structure 212 and maneuvering the wheeled support, to remove the plywood 216 from the concrete slab. After removal of the plywood 216, the formwork removing 210 machine moves the plywood 216 to a targeted location, whereby the hydraulic actuator is retracted to release the plywood 216, allowing the removed plywood 216 to be placed at the targeted location.

As shown in FIGS. 27A and 27B, the receiving and retaining mechanism 222 is configured to receive a portion of the plywood 216 therein as the wedges 220 separate part of the plywood 216 from the concrete. The length of the receiving portion may be selected to receive an end part of the plywood 216 therein, or may be dimensioned to receive a larger portion of the plywood 216. For example, and such as shown in FIG. 25, the receiving portion may be dimensioned to receive a substantial part, such as half of an 8 foot length of plywood, therein. Optionally, with a larger receiving portion, the clamping mechanism 222*b* may comprise two clamping elements or may have an inboard clamping element that is spring-loaded or otherwise biased to apply a retaining force at the plywood 216 when the plywood 216 has been sufficiently received in the receiving portion with the outer clamping element having an actuator for clamping the plywood at the outer end of the receiving structure. Optionally, the arm 218 and wedge mechanism 220 may be extendable relative to the lower part of the receiving portion, as shown in FIG. 25, via a hydraulic actuator 218*a* or linear actuator or the like that, when operated, moves or extends/retracts the wedge mechanism 220 relative to the receiving and clamping portion 222.

Thus, the formwork removing machine operates to separate the plywood 216 from the underside of a concrete slab or ceiling in an automated and safe and efficient manner, without requiring an operator to manually remove the plywood 216. The machine 210 engages the plywood 216 and pulls the plywood 216 down from the underside of the concrete slab and can readily move the removed plywood 216 to a targeted location, such as the ground surface or a shelf or cart or the like. The removing device 210 includes one or more wedges 220 that function to separate part of the plywood 216 from the concrete slab, whereby a clamping or retaining device 222 is actuated to clamp the plywood 216 for forcibly removing the plywood 216 from the concrete slab.

Figure 28:
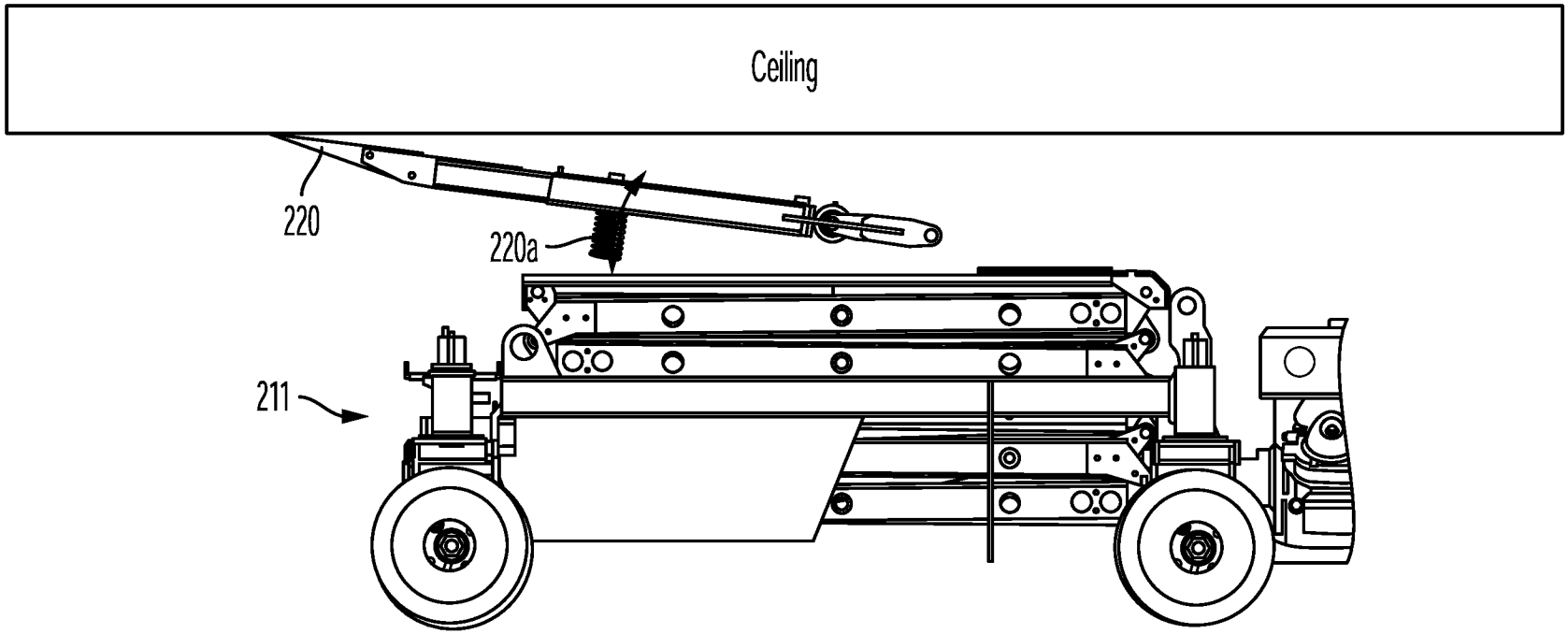
FIG. 28 is a side view of another formwork removing machine, shown with a spring-loaded arm and wedge for removing plywood formwork from a concrete ceiling structure.

Optionally, the arm 218, including the wedge 220 at the distal end of the arm from the raisable structure 212, may be pivotally mounted at the raisable structure 212 and may pivot upward from the raisable structure 212, such as shown in FIG. 28. In such an application, an upward force, which may be applied by a spring 220*a* or other biasing element, causes the arm 218 and wedge 220 to be biased upward toward and into engagement with the concrete slab so that the wedge is forced between the plywood 216 and the concrete slab when the arm 218 is moved toward the plywood 216. Optionally, the raisable structure 212 may comprise any suitable mechanism for raising/extending or lowering/retracting the arm 218 and plywood removing device 214. For example, the raisable structure 212 may comprise a telescoping arm or an articulating arm or the like that extends or retracts or adjusts responsive to one or more hydraulic actuators or the like (such as an arm and controls utilizing aspects of the arms and booms and controls described in U.S. Pat. No. 10,190,268, which is hereby incorporated herein by reference in its entirety). Optionally, the arm 218 may be raised and lowered by a manually operated and drivable hydraulic lift or a jack lift. For example, the wheeled base 211 may be a ride-on wheeled base or machine, such as forklift type machine or order picking machine, optionally with a platform or other receptacle or bin or the like beneath the formwork removing device for the plywood 216 to fall onto as it is removed.

The wheeled machine 210 may be dimensioned to maneuver easily between shoring posts while removing beams and formwork. The wheeled machine 210 may also be compactly stowed when not in operation. During operation, the wheeled machine 210 is remotely controllable, such as via an operator controlling the machine via a hand-held remote controller that is in wireless communication with the wheeled machine 210, further increasing worker safety. Optionally, the wheeled machine 210 may tow a trailer onto which the removed formwork may be stacked and stored, e.g., to permit efficient transportation from the work site.

Optionally, and such as shown in FIGS. 29-32, a formwork removal machine 310 may include a plywood gripping device 324 that comprises a pneumatically operated gripper 324*a* attached to an articulating and/or extending arm 326. The arm may extend from a scissor lift, such as a lift similar to the raisable structure 112 or lift structure 212, discussed above, that is raisable to position the gripper 324 at the underside of the plywood 316 to firmly engage the gripping elements 324*a* of the gripper at the plywood 316 from below. The wheeled base and lift or raising mechanism of the machine 310 may be substantially similar to the bases and mechanisms of the machines 110, 210, discussed above, such that a detailed discussion of these aspects of the machines need not be repeated herein.

Figure 29:
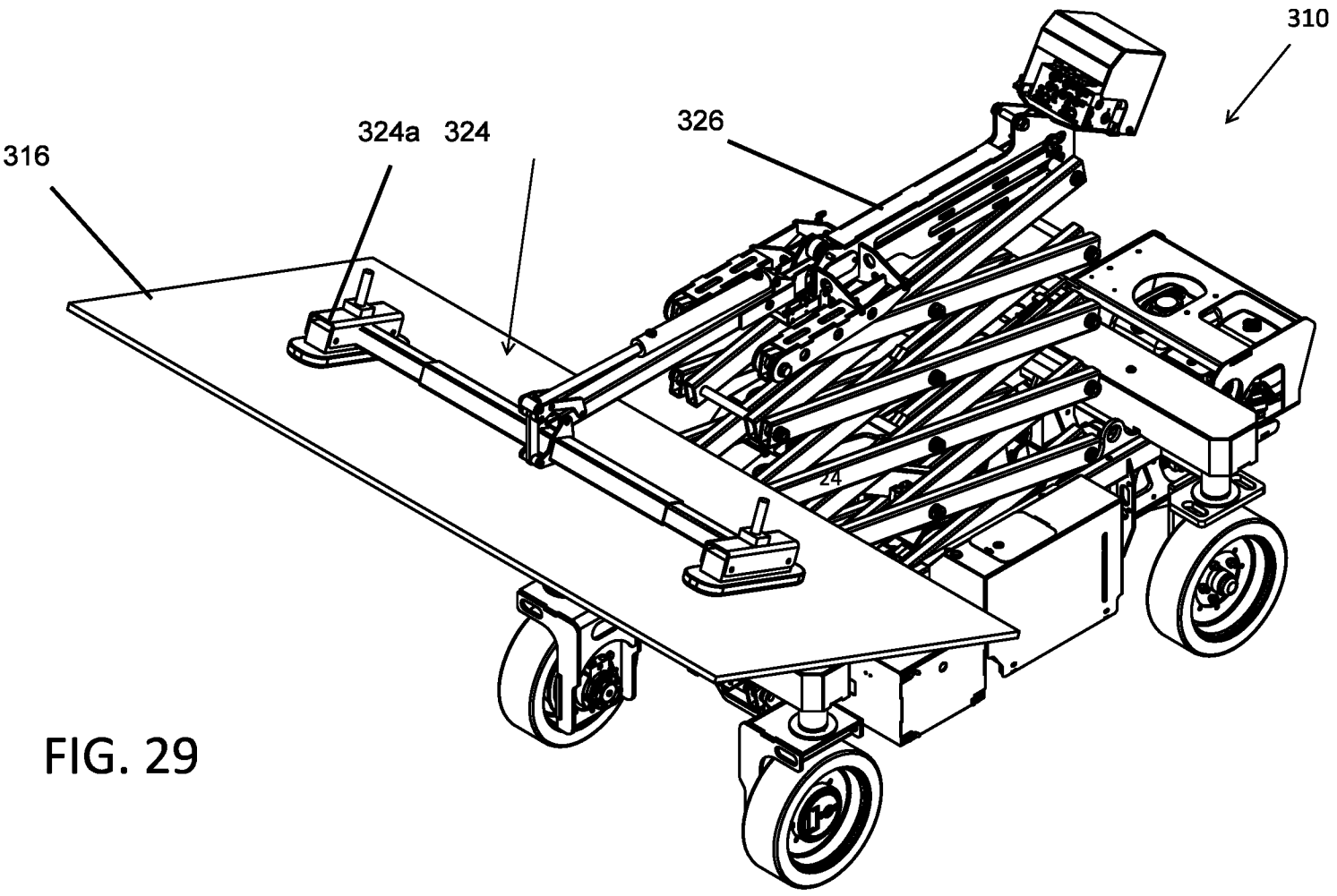
FIGS. 29-32 are perspective views of a formwork removing machine, shown with a pneumatic plywood gripper at a raisable and lowerable structure of a wheeled base.
Figure 30:
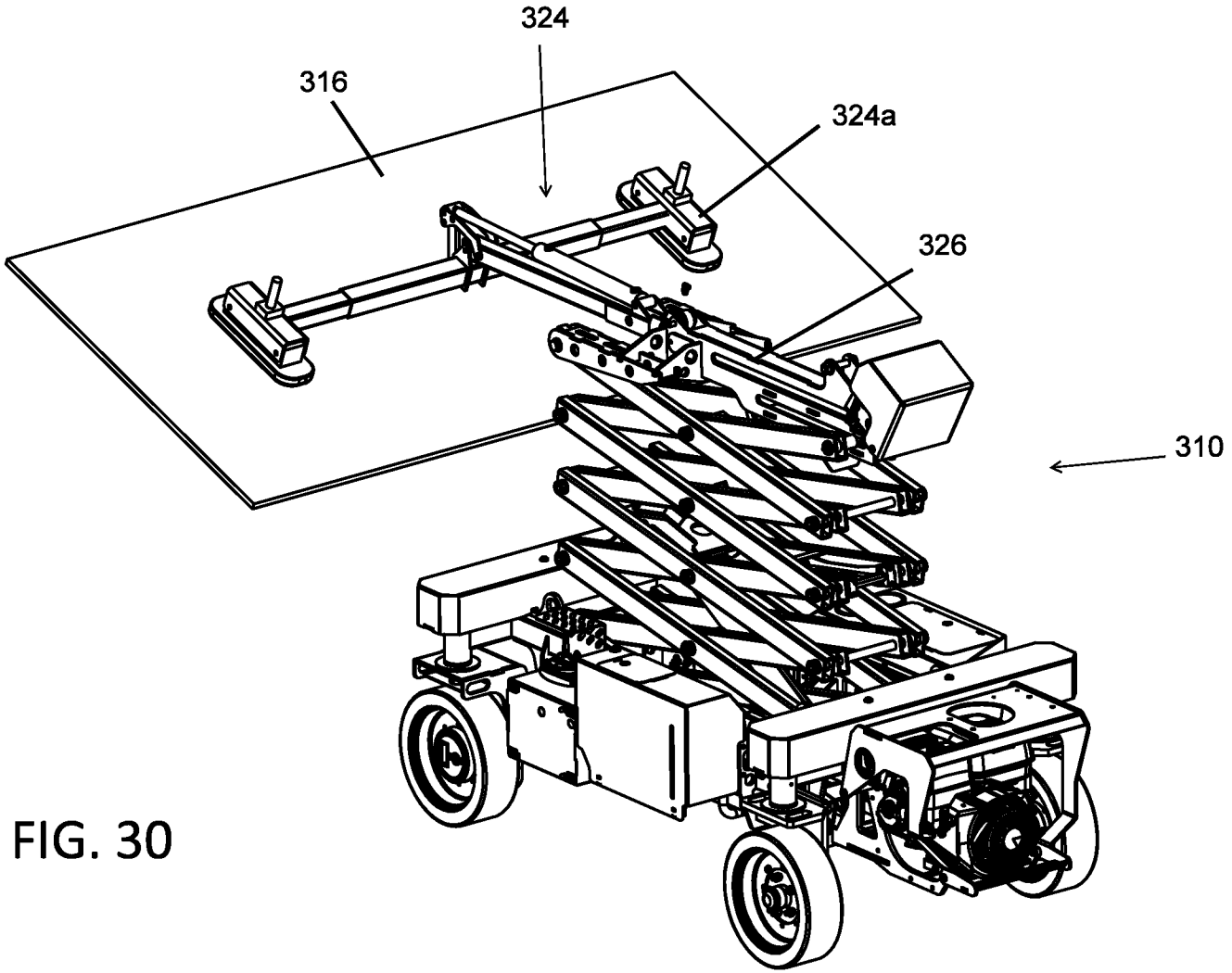
Figure 31:
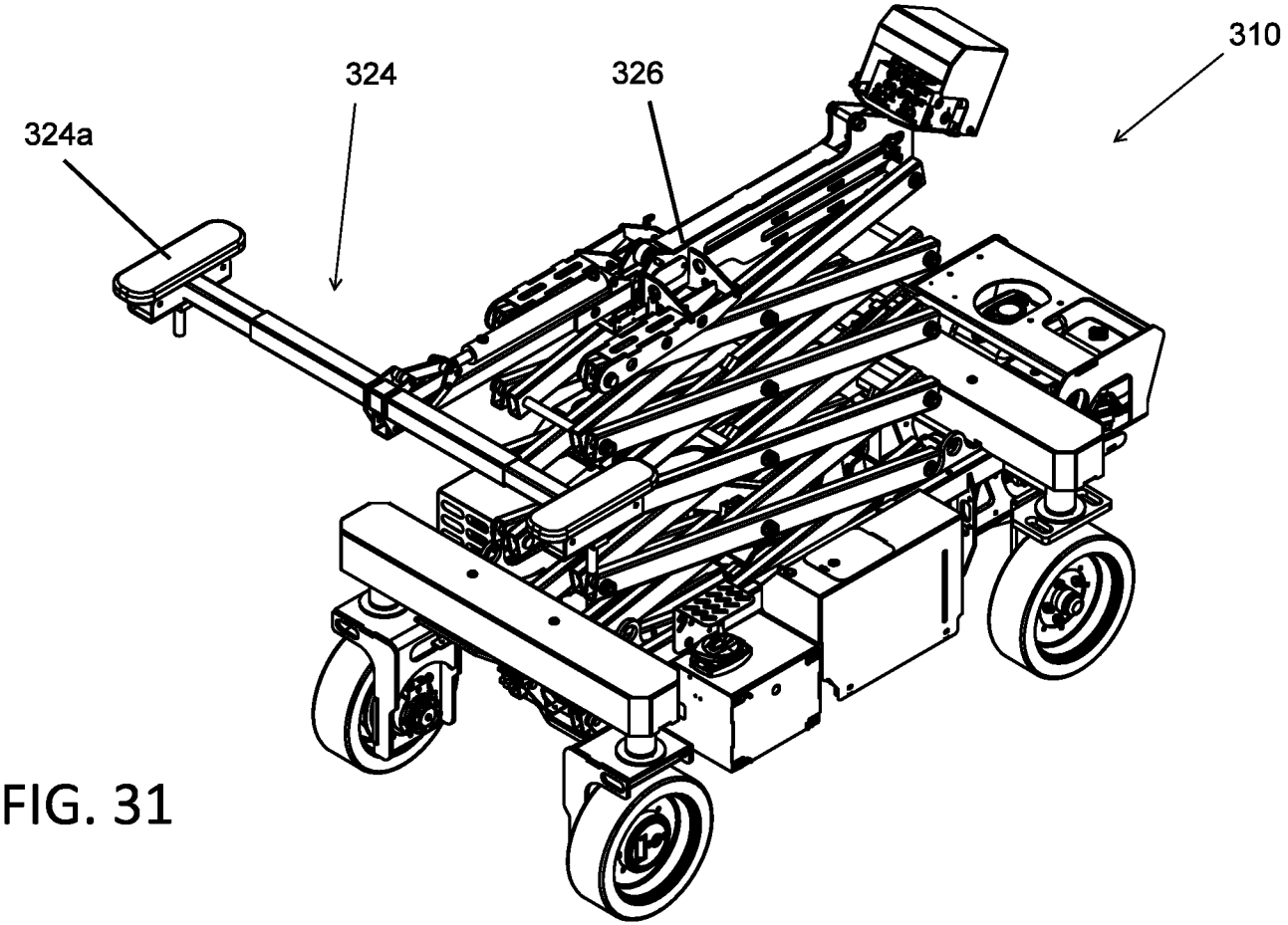
Figure 32:
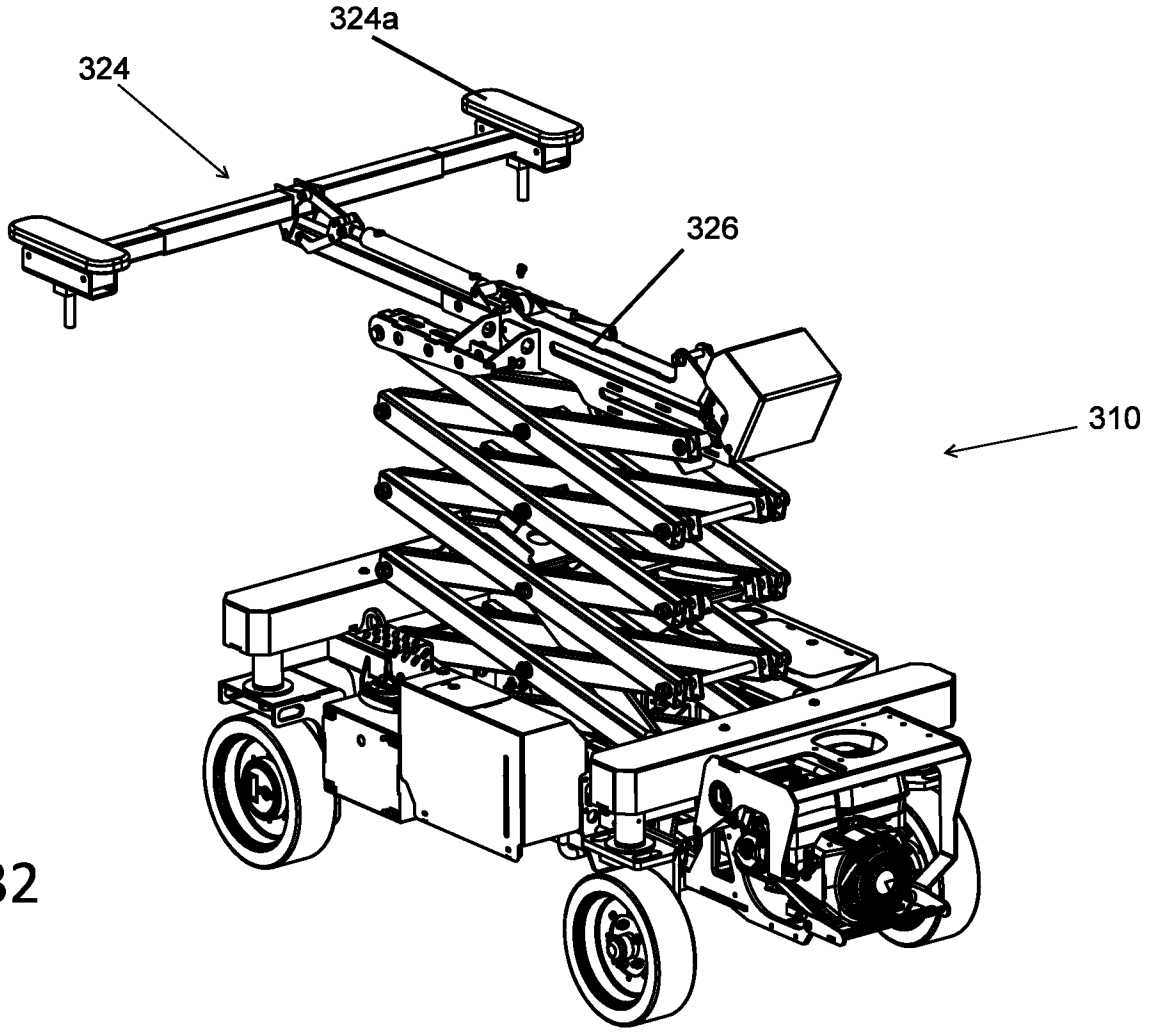
Figure 33:
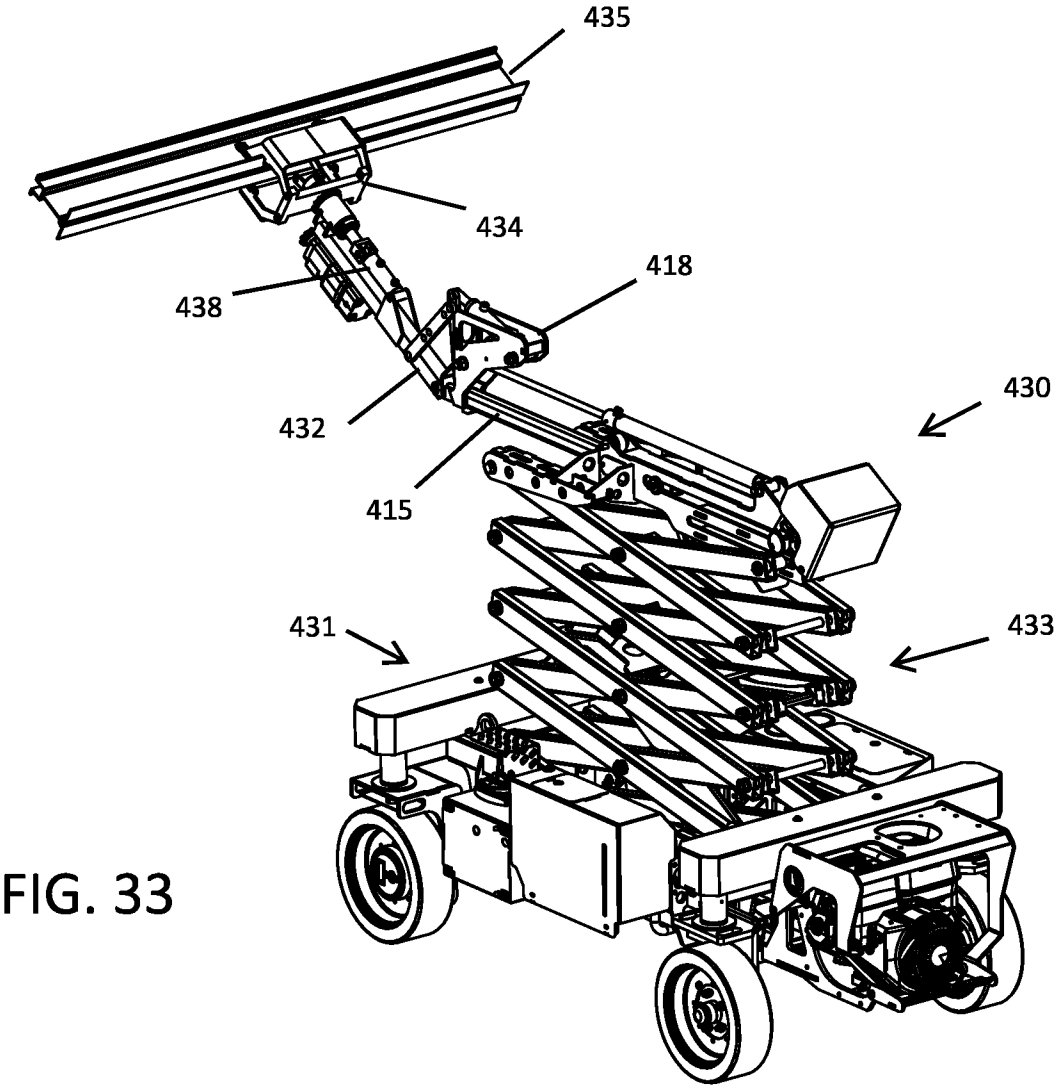
FIGS. 33-35 are perspective views of a formwork removing machine for removing formwork beams, shown with a beam gripper at a raisable and lowerable structure of a wheeled base, a boom in an extended position, and an arm tilted upward relative to a support structure.
Figure 34:
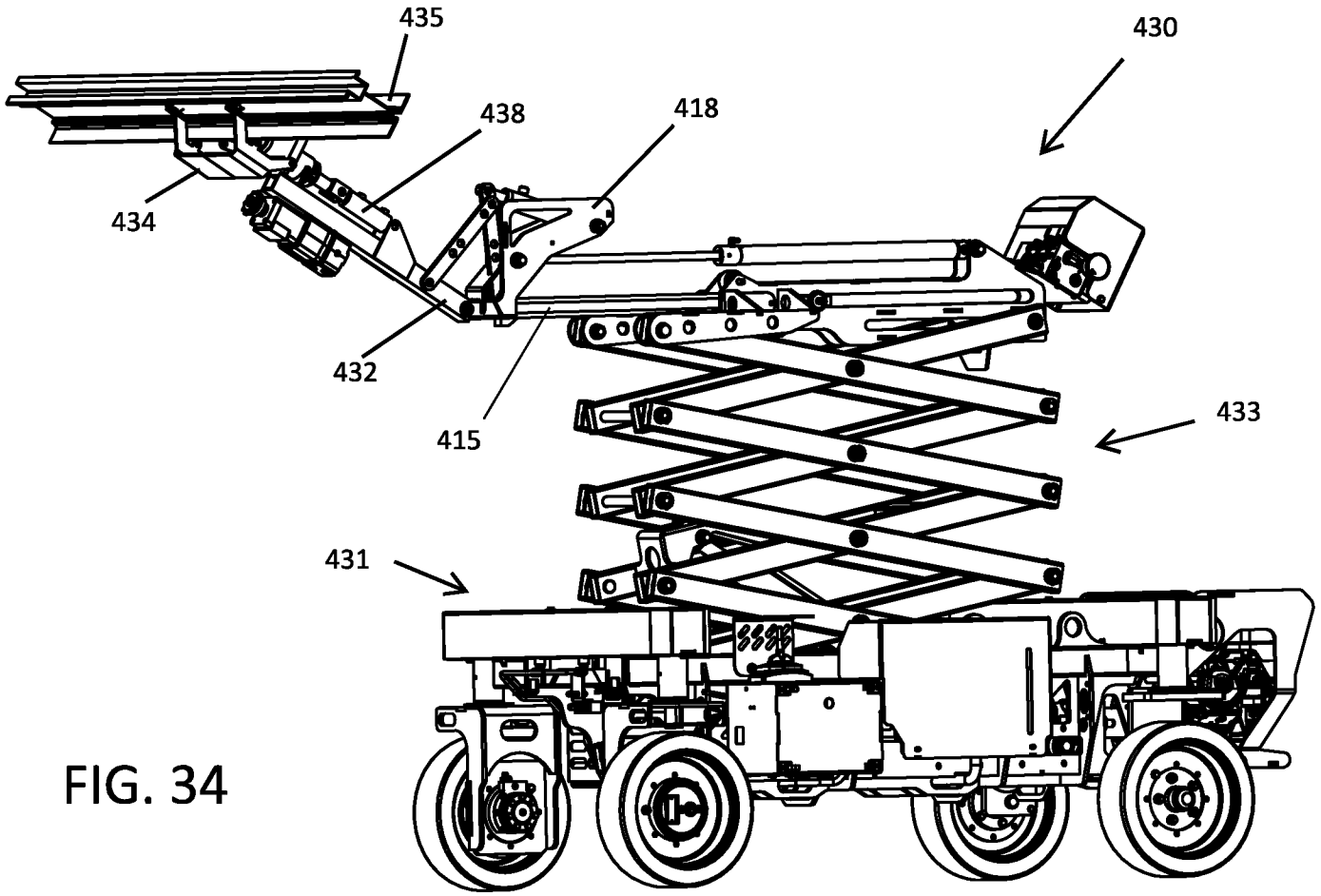
Figure 35:
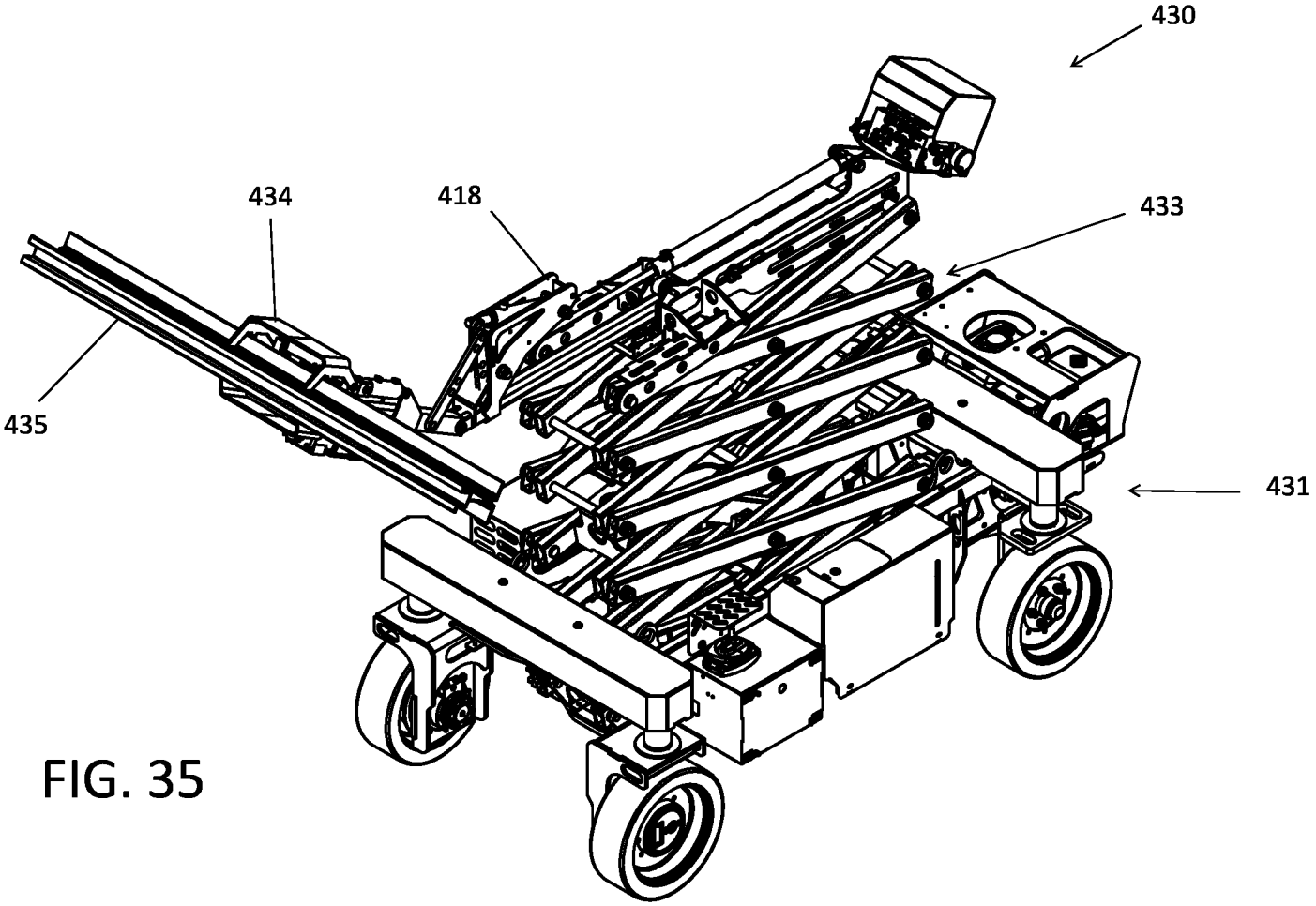
Figure 36:
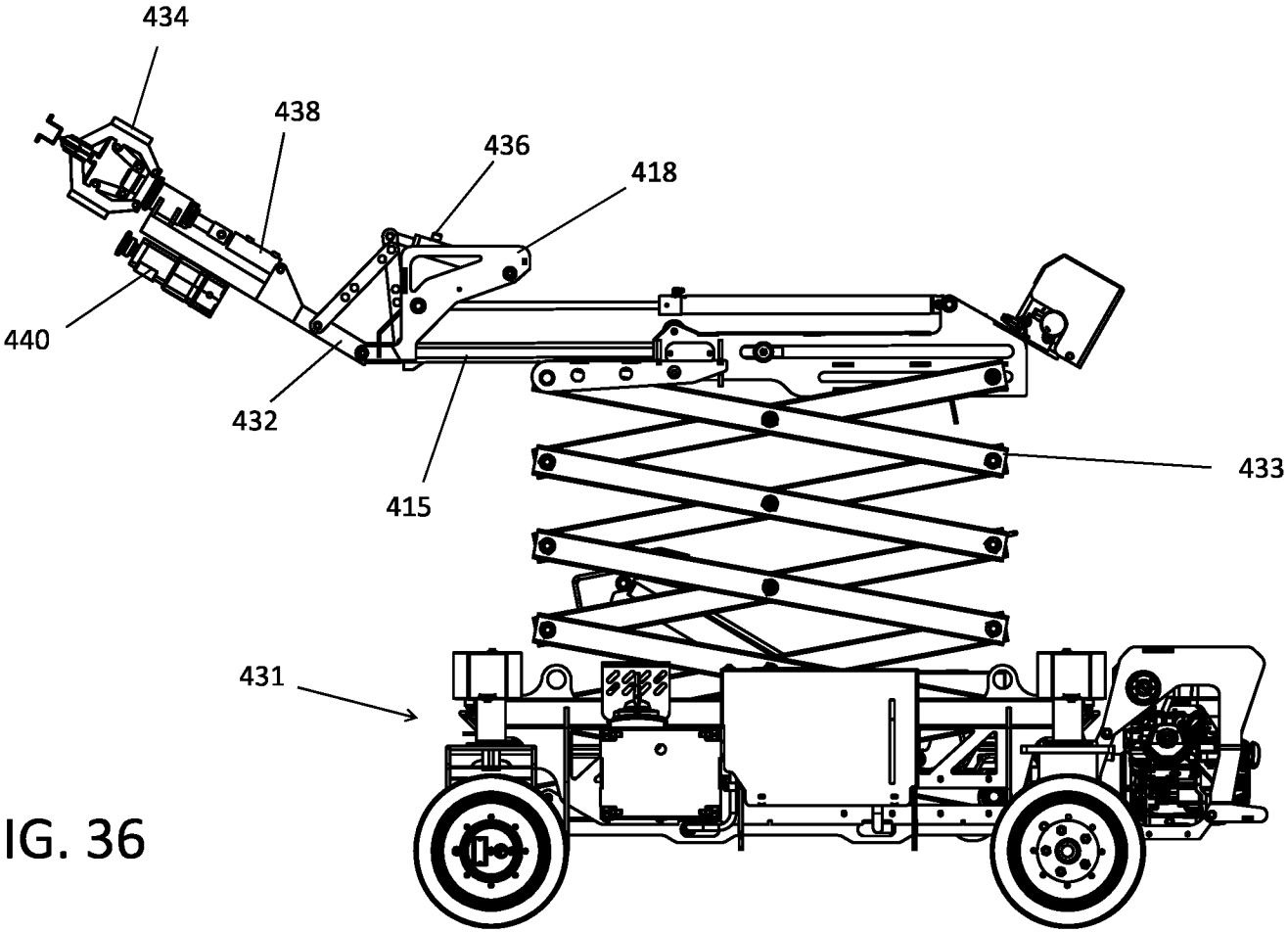
FIG. 36 is a side view of the formwork removing machine of FIGS. 33-35.
Figure 37:
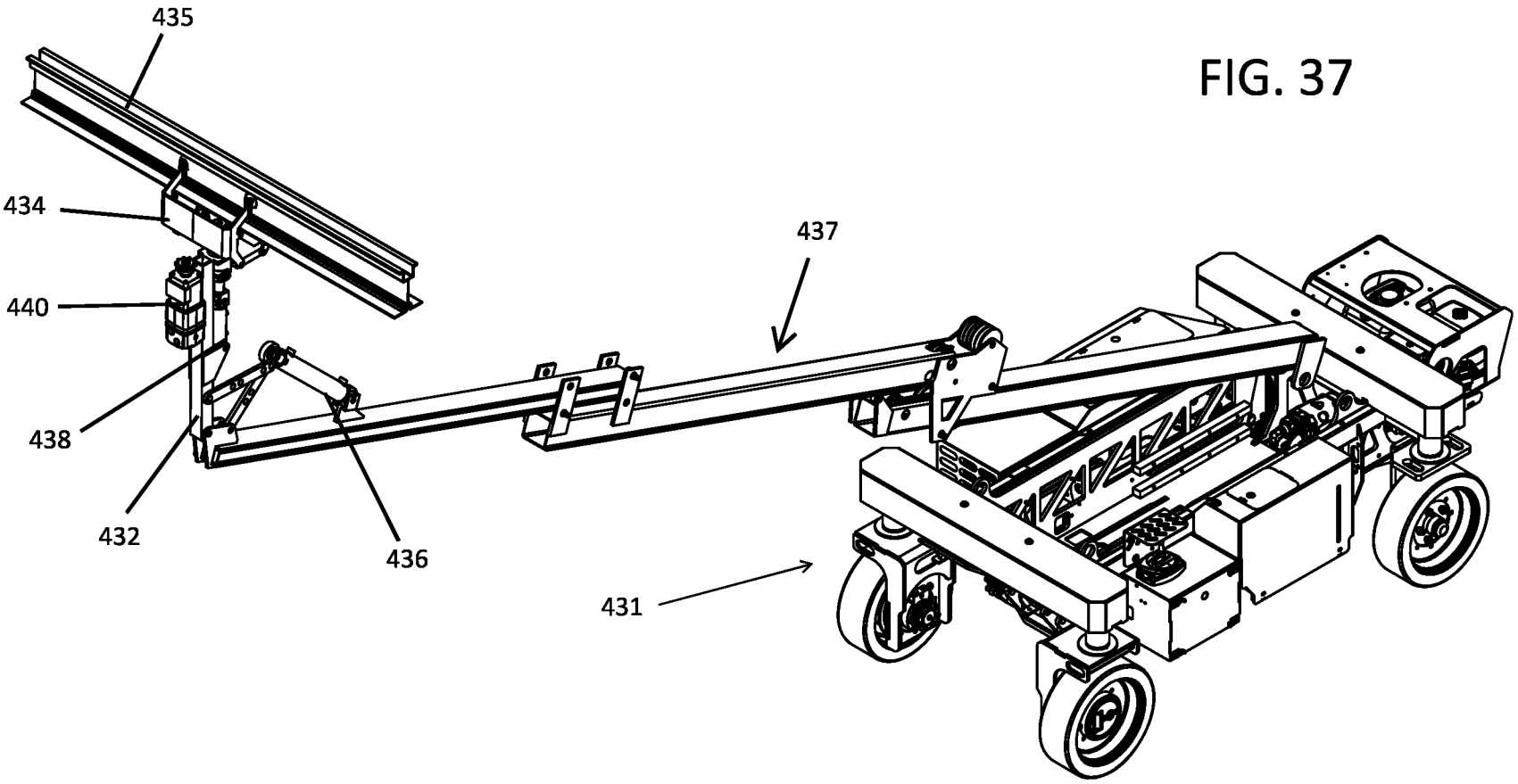
FIGS. 37-39 are perspective views of a formwork removing machine for removing formwork beams, shown with a beam gripper at a telescoping arm of a wheeled base, the telescoping arm in an extended position.
Figure 38:
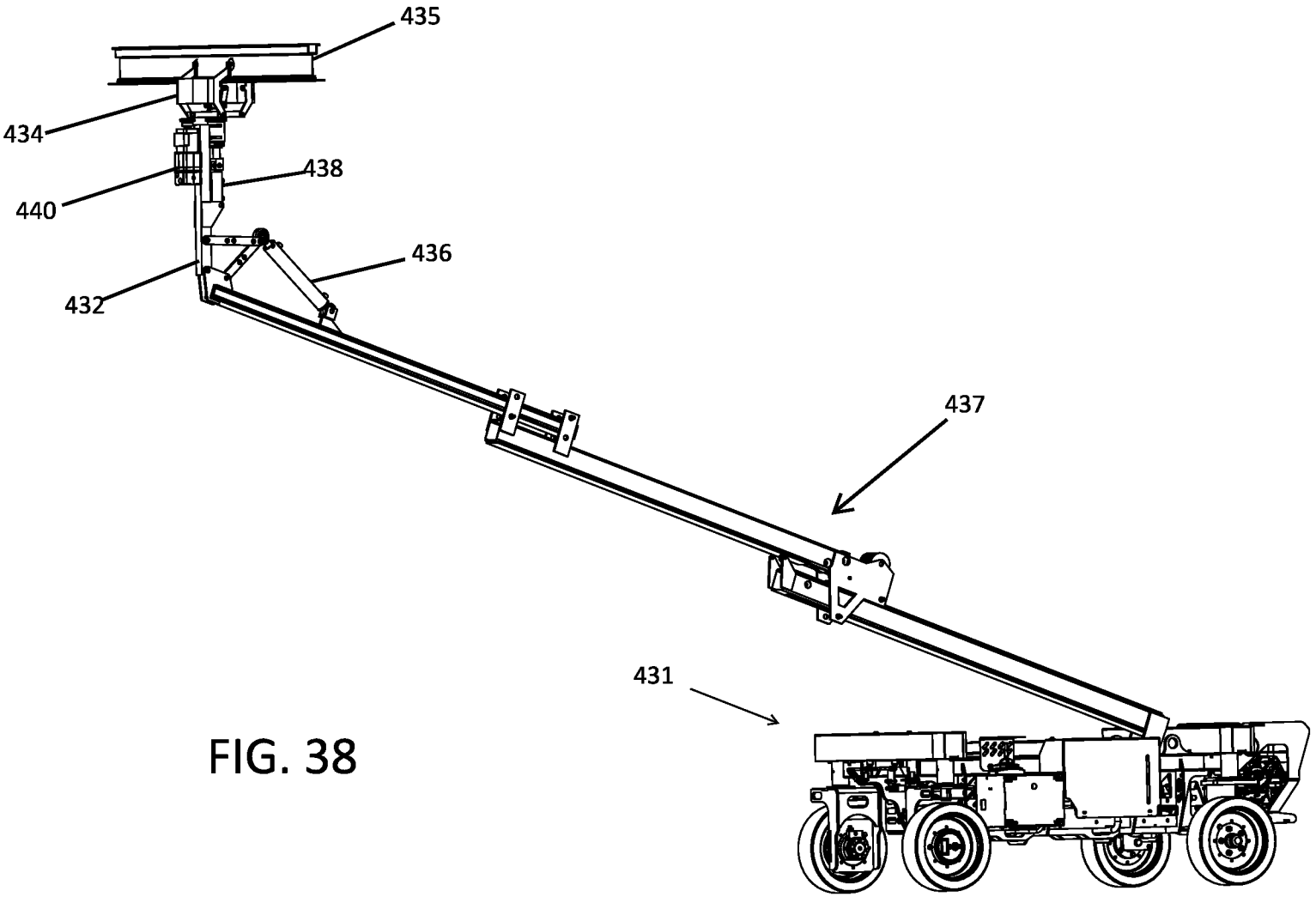
Figure 39:
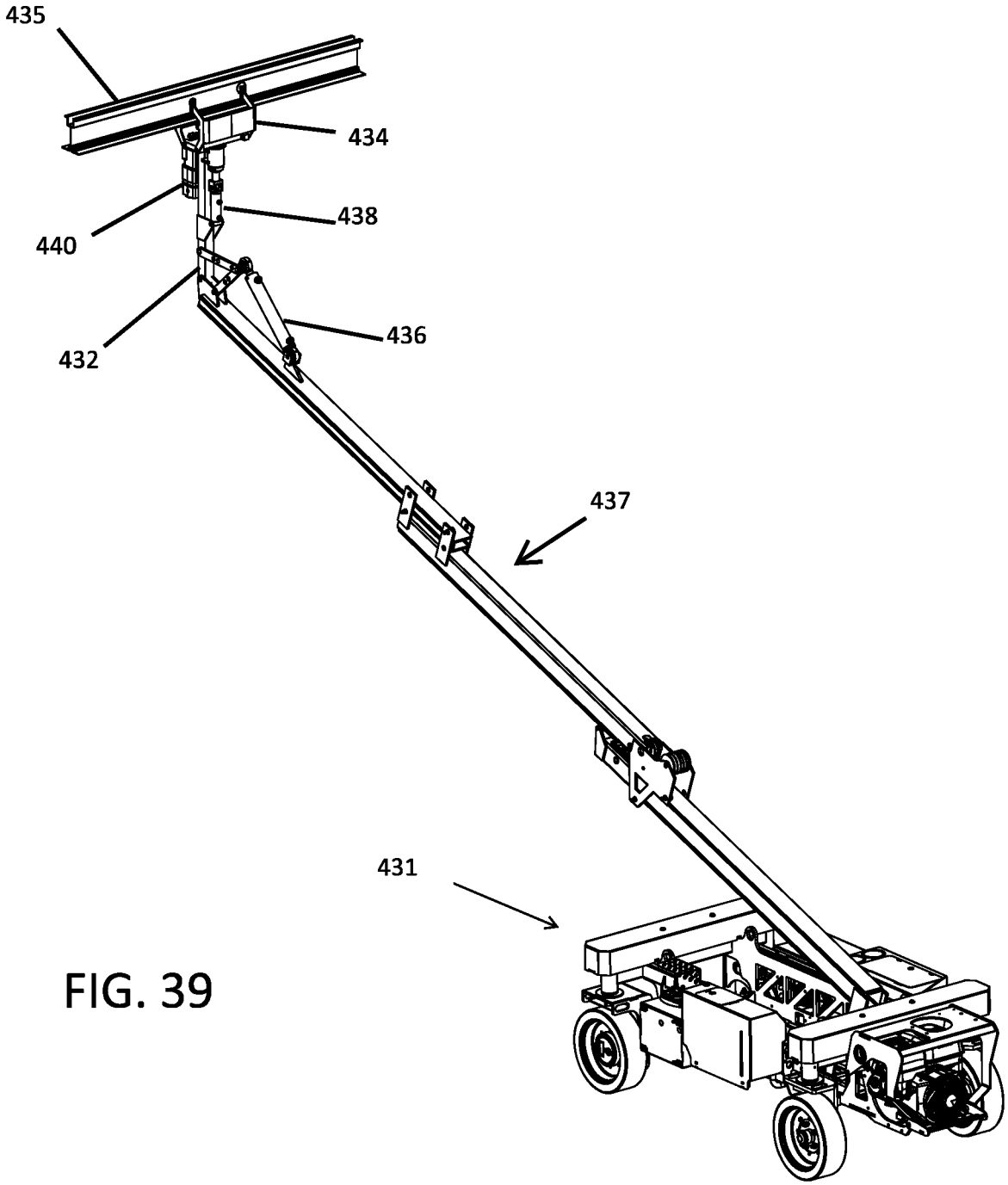
Figure 40:
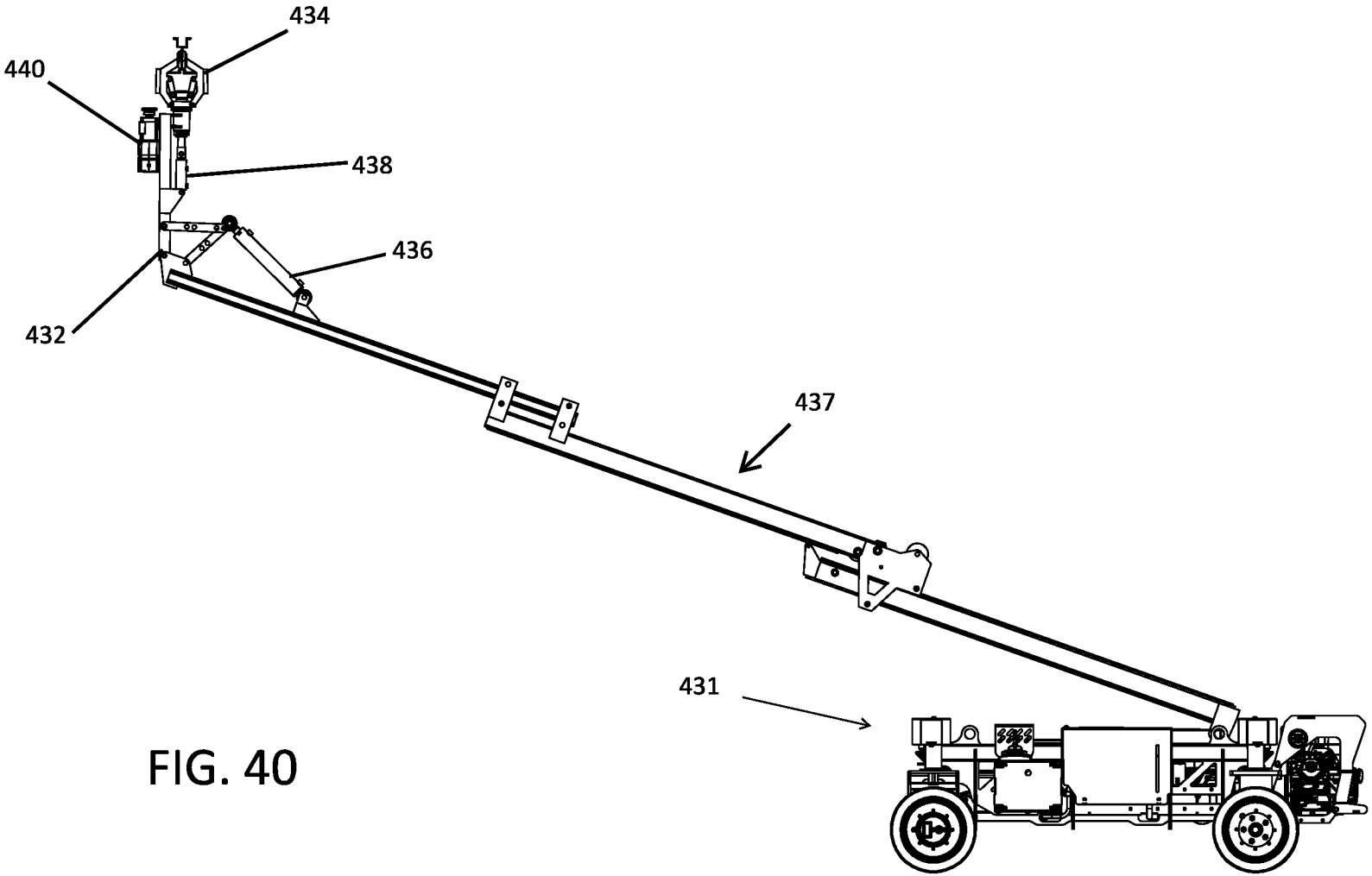
FIG. 40 is a side view of the formwork removing machine of FIGS. 37-39.

When the gripper 324 is engaged with the underside of the plywood 316, the gripper 324 may be activated to generate a suction at the plywood 316 to secure the plywood 316 at the gripper element 324*a*. The gripper 324 is then lowered, for example, by retracting the arm 326 or by lowering the raisable structure, freeing the formwork or plywood 316 from the underside of the concrete slab or ceiling. As shown in FIGS. 29 and 30, after removing the formwork 316, the gripper 324 continues to retain the plywood 316 as the arm 326 lowers or otherwise repositions the plywood 316, such as to move and orient the plywood 316 at a targeted location, whereby the gripper element 324*a* is deactivated to release the plywood 316 to store or stack the plywood 316 at a targeted location. As shown in FIGS. 29-32, the gripper 324 is pivoted relative to the end of the arm 326 via an actuator 326*a*, such that the gripper can be initially positioned facing upward toward the formwork (FIGS. 31 and 32), and then, after removing the formwork, can be pivoted to face generally downward (FIGS. 29 and 30) for releasing the formwork at the targeted location.

When removing the formwork or plywood from beneath a cured concrete slab or ceiling structure, at least some of the support beams and posts supporting the plywood or holding the plywood in place must be removed before the plywood is removed. Optionally, and now with reference to FIGS. 33-41B, a formwork removal machine or beam-removal machine 430 includes an arm 432, which is mounted at a wheeled base 431, similar to a wheeled base 111 or 211 or 311 described above, and a gripping mechanism 434 located at a distal or beam end of the arm 432. The gripping mechanism 434 includes a pair of pivoting jaws having a gripping surface that conforms to the central section of an I-beam 435.

As shown in FIGS. 33-36, the arm 432 may be mounted at a raisable structure 433, such as a scissor lift structure or the like, similar to the raisable structure 112 or 212 as described above, that is mounted at the base 431. Alternatively, and such as shown in FIGS. 37-41C, the arm 432 may be mounted at an end of an articulating and/or extending arm 437 that is mounted at the wheeled base 431. The raisable structure 433 or arm 437 raises or extends and lowers or retracts the arm 432 and gripping mechanism 434 to move the gripping mechanism 434 into engagement with the beam for gripping the beam 435 from below or from a side of the beam. In use, the gripping mechanism 434 would typically grip from below the beam 435 due to the presence of plywood and concrete at the top side of the beam 435.

In the illustrated embodiment of FIGS. 37-41C, the arm 437 comprises an extendable and retractable arm having multiple sections that move relative to one another to extend or retract the arm and gripping mechanism 434. As shown in the illustrated embodiment, the sections of the arm 437, when extended, are cantileverly supported relative to the adjacent arm or section. During extension and retraction of the arm 437, the arm sections may move via rollers and brackets at the inner or proximal end of the respective arm section engaging and moving along the adjacent arm section. Such movement may be responsive to actuation of a cable or chain that imparts movement of the distal or outermost arm section relative to the base 431, such as by, for example, pulling the bracket at the inner or proximal end of the arm 437 towards the outer or distal end of the adjacent arm section, or such as via rotatably driving the rollers or other suitable means.

The gripping mechanism 434 is pivotally mounted at the distal end of the arm 432, which is pivotally mounted at the end of the extendable arm 437, and which is pivotable relative to the arm 437 via a hydraulic actuator 436 or other actuating means. Optionally, and in reference to FIGS. 33-36, the gripping mechanism arm 432 may be pivotally mounted at a support structure 418 at an upper end of the raisable structure 433, with the support structure 418 mounted at an extendable boom 415 similar to like elements described above (see, for example, support structure 118 and boom 115), such that a detailed discussion of the support structure need not be repeated herein. The gripping mechanism 434 may be coupled to another hydraulic actuator 438, or other actuating mean, that extends and retracts to close and open the jaws of the gripping mechanism.

Figure 41B:
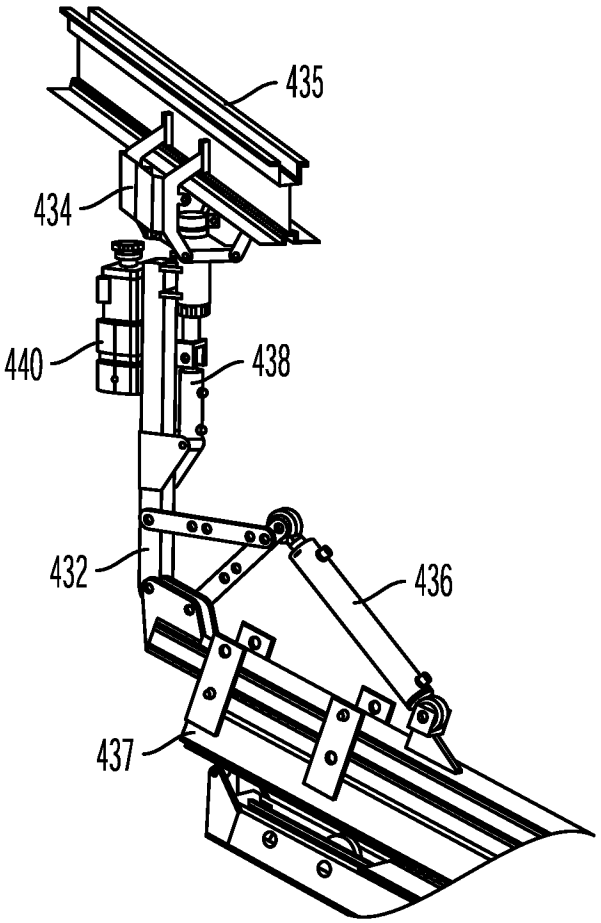
FIGS. 41A-C are partial perspective views of the formwork removing machine of FIGS. 37-40.
Figure 41A:
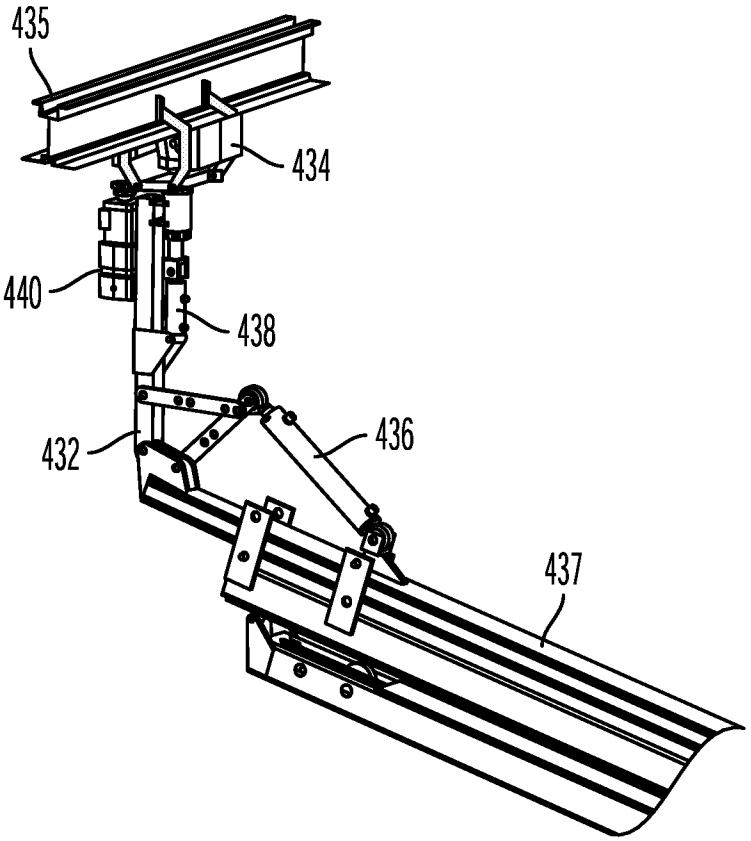
Figure 41C:
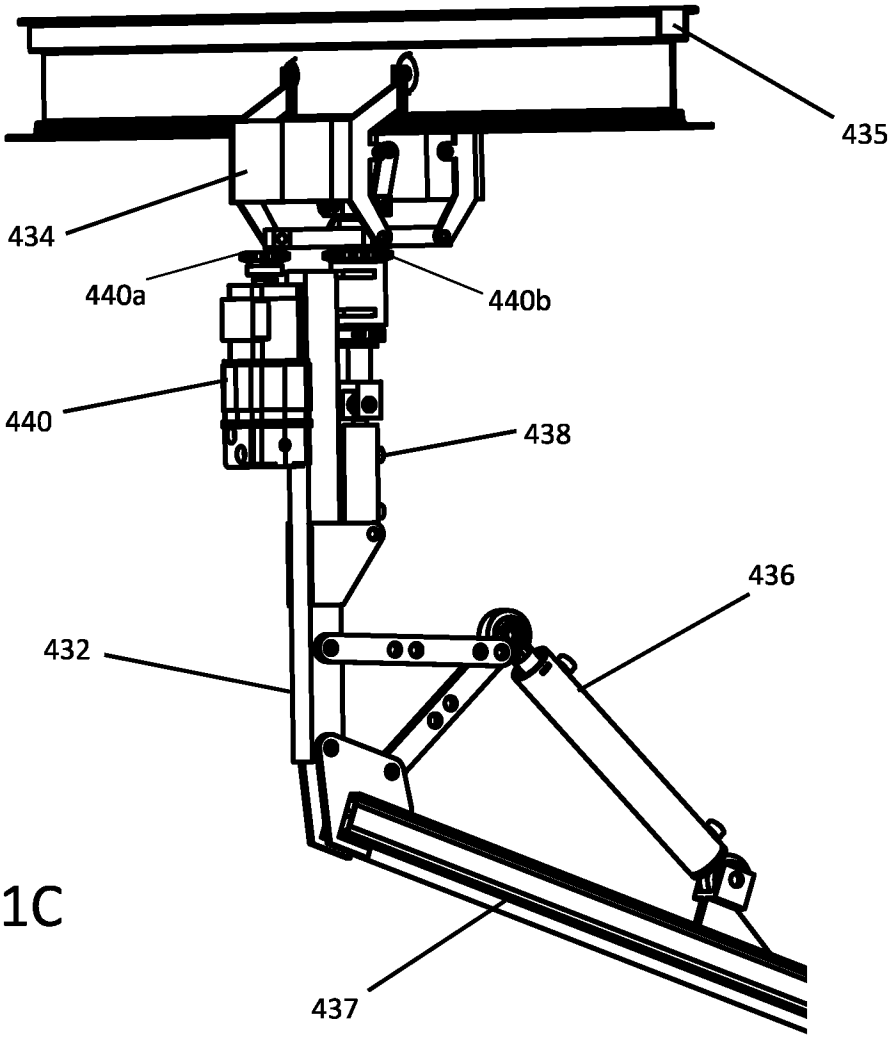

Because the beams may be nailed or otherwise affixed to the formwork, the gripping mechanism 434 may also include a rotary actuator 440 that rotates the jaws to apply a twisting force at the beam, when the beam is clamped between the jaws, to free the beam for removal. As can be seen in FIGS. 41A-C, the rotatory actuator 440 may comprise a motor, such as a hydraulically operated motor, that rotatably drives a gear 440*a* that, in turn, rotatably drives a gear 440*b* at the base of the jaws, such as via a chain or linkage not shown, to rotate the gripping mechanism 434 about the longitudinal axis of the actuator 438. After the beam has been broken free from the plywood or formwork and removed, the arm 432 and the raisable structure 433 or arm 437 may be repositioned to lower the removed beam 435. The gripping mechanism 434 may be opened to release the lowered beam 435 so as to set or drop the beam 435 onto the ground surface or other suitable storage location.

Figure 42:
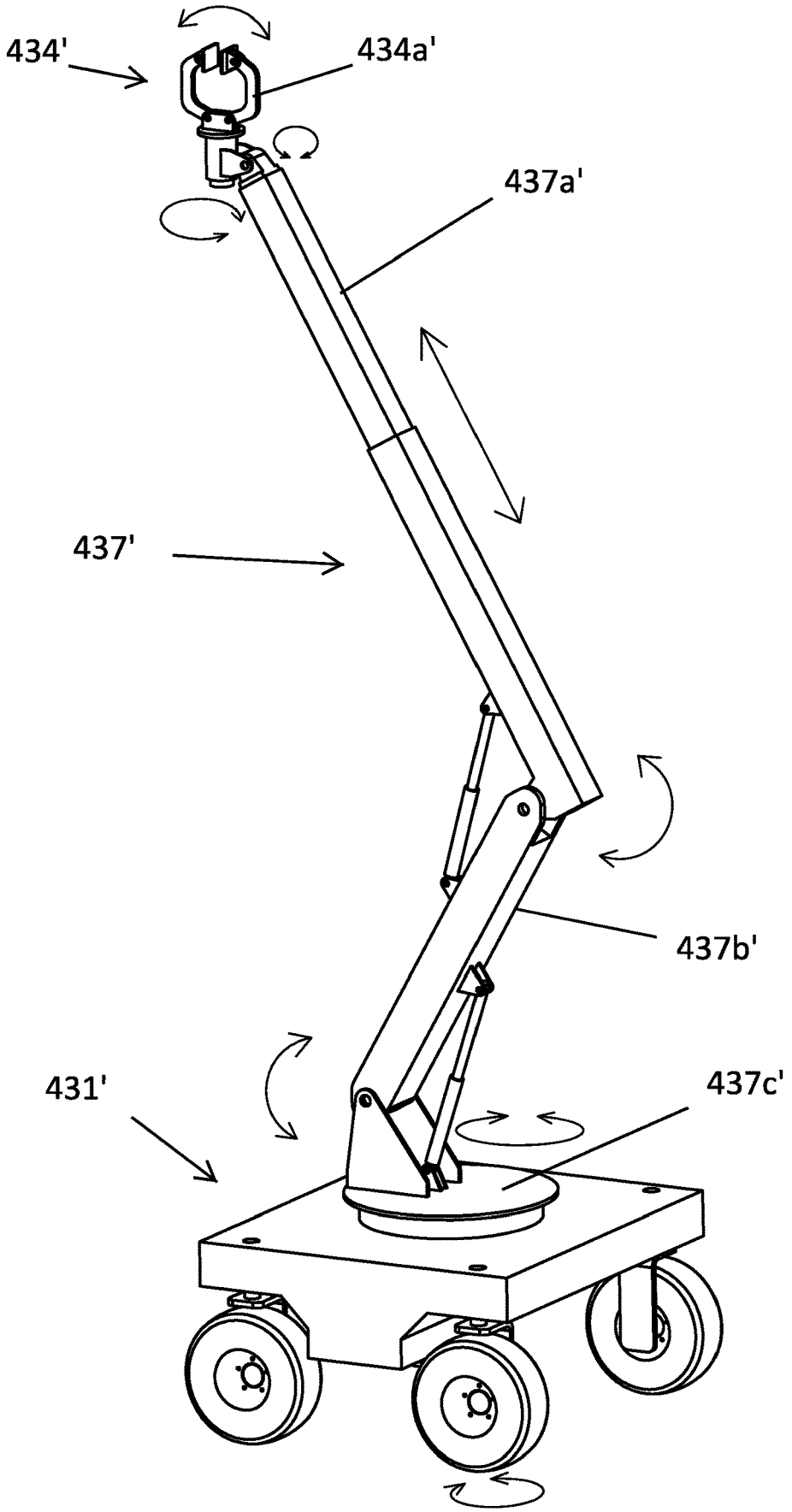
FIG. 42 is a perspective view of another formwork removing machine for removing formwork beams.
Figure 43:
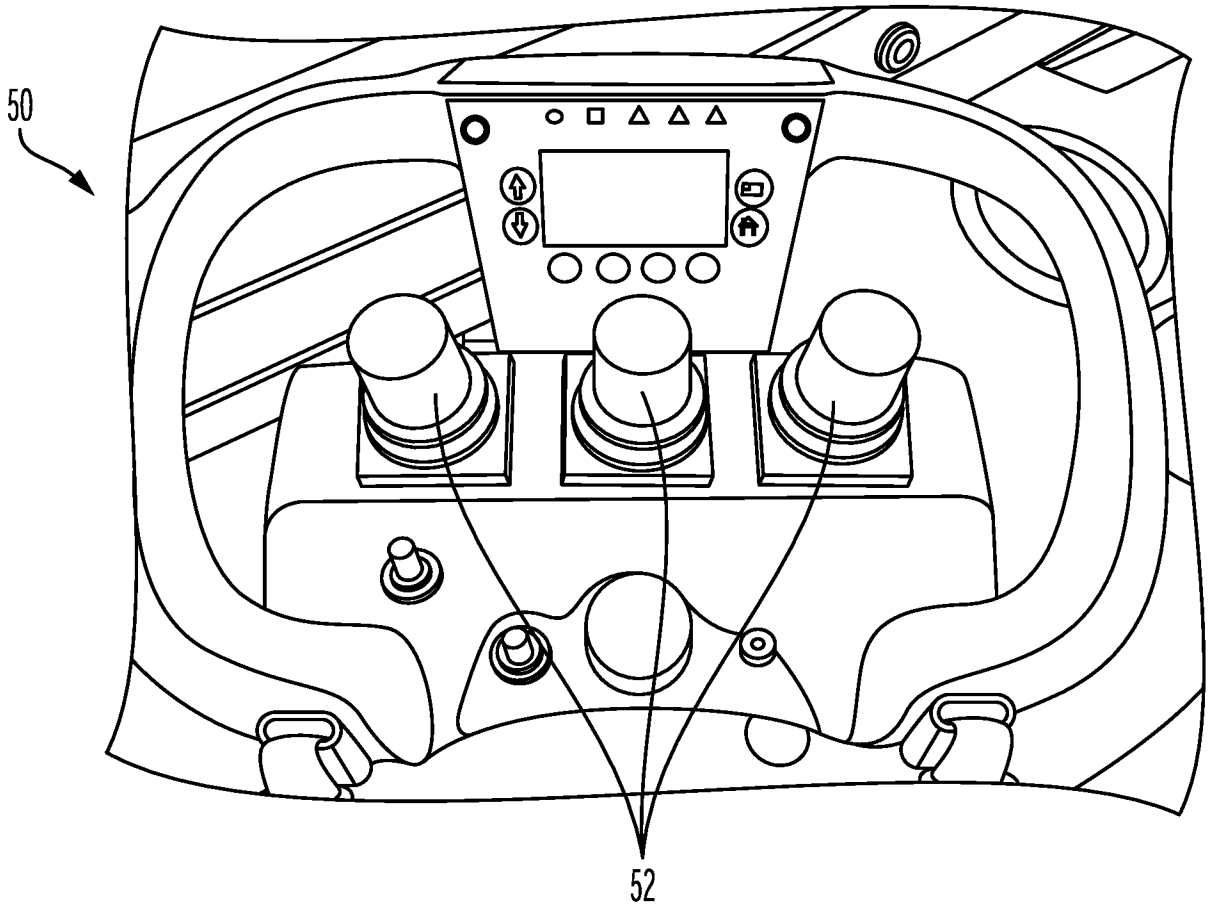
FIG. 43 is a view of a control panel of a formwork removing machine.

Optionally, and such as shown in FIG. 42, the gripping mechanism 434' may be rotatably and adjustably mounted at the end of an arm 437' that comprises two or more telescoping arms or sections 437*a'* that are telescopingly extendable and retractable, such as via a hydraulic actuator or cables or chains or the like disposed within or otherwise along at least one of the telescoping arm sections. In the illustrated embodiment, a proximal end of the telescoping arm sections 437*a'* is pivotally mounted at a distal end of a base arm 437*b'*, which has a proximal end that is rotatably mounted at the wheeled base 431'. The base arm is pivotally mounted at a rotatable base 437*c'* that rotates about a generally vertical axis relative to the wheeled base 431', for example such as via a rotary drive device or system at the base, and the base arm 437*b'* pivots about a generally horizontal axis relative to the base 437*c'* via extension and retraction of an actuator at the base 437*c'*. Similarly, the telescoping arms 437*a'* pivot about a generally horizontal axis relative to the base arm 437*b'* via extension and retraction of an actuator between the base arm 437*b'* and the proximal telescoping arm.

Thus, the gripping mechanism 434' can be moved or maneuvered to any location via moving the wheeled unit and then adjusting the angles and orientation of the rotatable base 437*c'* and arms 437*a'*, 437*b'*. The gripping mechanism 434' is rotatably mounted at the distal end of the telescoping arms 437*a'* and can rotate about a pivot axis that is normal to the longitudinal axis of the telescoping arms 437*a'*, such as via a bracket that mounts the gripping mechanism at the distal end of the arm, and the jaws 434*a'* of the gripping mechanism can also rotate about another pivot axis that is normal to the pivot axis of the bracket at the end of the arm. Thus, the jaws 434*a'* can be maneuvered to position the jaws 434*a'* at the beam, whereby the jaws 434*a'* may be clamped onto the beam for removing the beam.

Optionally, the base unit or wheeled support may have a raisable/lowerable device or structure, with an attaching portion or head at an upper end of the raisable/lowerable device, which is configured for detachable attachment of either the mechanism and retaining mechanism or the gripping mechanism, such that the machine can be adapted for removing plywood from the underside of the concrete slab or ceiling and for removing the support poles and beams from the underside of the concrete slab or ceiling. Thus, a single machine may be used for both removal processes, with the formwork engaging device or mechanism being switched to adapt the machine for the respective process.

As shown in FIG. 29, the machine may include a control panel 50 that provides the operator with controls to raise and lower the removal device and to extend the device and pivot the device and to grasp and release the formwork, via extension and retraction of the respective actuators or hydraulic cylinders. For example, the control panel 50 may include a combination of controls that affect one or more of the raising and lowering of the lift mechanism from the base, the extension and retraction of the boom upon which the formwork-removal device is mounted to and from the lift mechanism, the upward and downward tilt of the formwork-removal device relative to the arm or boom or support structure, and the opening and closing of the gripping mechanism relative to the wedge element or support structure. The control panel 50 also provides controls for controlling operation of the wheeled support so the operator can maneuver the wheeled support to a desired location before and/or after the removal device removes formwork. In the illustrated embodiment, the control panel 50 includes joystick controls 52 for the operator to use to control the head tilt, the boom and the clamp or grasping device. However, it should be understood that the control panel may include push buttons, slide switches, touch enabled screens, or any other element configured to direct the motions of the formwork removing machine.

During operation of the machine, the controls may limit the propel speed of the wheeled support if the scissor lift mechanism is raised, such as, for example, in response to a sensor at the lift mechanism. The controls may also limit the propel speed of the wheeled support if the machine is on an angled drive or support surface, for example such as in response to a level sensor at the wheeled support. The controls may also limit the raising speed of the lift mechanism as it gets close to the ceiling and approaches its working height, for example such as in response to a distance-sensing sensor (such as an ultrasonic sensor or the like) at an upper part of the lift mechanism or other sensor that determines when the lift mechanism is nearing the appropriate working height. The controls may also disable the raise function of the lift mechanism if the machine is at an angled support surface, for example such as in response to a level sensor at the wheeled support.

After the operator has used the formwork removing machine to remove a formwork element, the operator may actuate a home or return button or switch or input at the control panel 50 (such as at the end of one of the joysticks or elsewhere at the control panel) to cause the machine to automatically return to its initial or home settings to position the head tilt, boom and clamp to their ready positions for the next removal or stripping cycle. For example, the operator may press and hold a reset push button to begin the sequence that (i) drives the head tilt up function for an adjustable time duration, (ii) drives the boom retract function for an adjustable time duration or until the boom limit switch is activated, and (iii) drives the clamp open for an adjustable time duration, whereby the boom will be retracted and the head will be tilted upward with the jaws open, so as to be ready for the next removal or stripping cycle. When the reset sequence is active, the sequence can be stopped by pressing the reset push button again. Actuation of the head tilt, boom or clamp joystick to a degree that is greater than an adjustable threshold will also stop the sequence. Such joystick commands may be ignored below this threshold such that the return or home sequence is not stopped if a slight bump or similar occurs at any of the joysticks.

Optionally, the formwork-removal device or the beam-removal device may be selectively attached to the wheeled, motorized machine or base, and are selectively positioned at an operating position for performing the desired or selected task. That is, the mechanisms may be interchanged at a common or universal base 111 or 211 or 431 and/or raisable/lowerable or extendable/retractable structure 112 or 212 or 433 or 437 at the base. For example, once the slab has hardened, workers may attach the beam-removal device to the raisable structure of the wheeled base to disassemble and remove the beams supporting the formwork. Once the beams have been removed, workers may remove the beam-removal device and attach the formwork-removal device to the raisable structure of the wheeled base to remove the formwork or plywood from the slab. Optionally, the beam removal mechanism may be mounted at one end of the raisable structure and the formwork-removal device may be mounted at the opposite end of the raisable structure, such that a single machine is selectively operated to perform the desired operation.

During operation of the machine, an operator may remotely drive the wheeled base, fitted with beam-removal device, at the worksite, such as via a remote controller that is operable to control driving and steering of the wheels, extension/retraction of the raisable structure, and pivoting/rotating/clamping/unclamping of the gripping device. The operator remotely controls the beam-removal device to sequentially remove each formwork beam by gripping each beam from below, rotating the beam to be free from nails or other attachments and from the plywood, repositioning the beam and releasing the beam at a targeted location, such as onto a trailer towed by the wheeled base. As needed, the operator maneuvers the wheeled, motorized machine between remaining shoring posts to be able to access the next beam in the sequence. Optionally, the beam-removal device may also be used to remove some of the vertical posts by grasping the posts and (such as after the posts are adjusted to be lowered from the beams) lifting and moving the posts to a desired or targeted location.

After the beams are removed, the operator may remotely control the wheeled machine to transport the beams, on the trailer or other storage platform or the like, away from the worksite. Operators may then fit or adapt the wheeled machine with the formwork-removal device and remotely control the wheeled machine and the formwork-removal device to sequentially remove the formwork or plywood from the underside of the concrete slab or ceiling structure. The operator, using the remote controller, may extend the raisable structure so that the wedge mechanism contacts the hardened slab, then drive the wheeled, motorized machine forward, causing the wedge mechanism to engage with the plywood and separate part of the plywood from the concrete slab. As the plywood is freed by the wedge mechanism, the operator remotely controls the gripping mechanism to hold and retain the removed plywood. The operator then remotely operates the wheeled, motorized machine and the formwork-removal device to lower and position the plywood and release the plywood at a targeted location, such as onto the trailer, if applicable.

The operator control of the machine may be achieved via a wireless remote controller, which has multiple controls or inputs to allow the operator to control various motors and actuators of the machines. For example, the machine may have a gasoline powered engine that powers or drives a hydraulic pump for providing pressurized hydraulic fluid to hydraulic motors and hydraulic actuators of the machine. For example, the controller may control the machine to hydraulically drive the steering mechanism and the wheel drive motors to maneuver the base and the machine over the support surface or floor, and may separately control one or more hydraulic actuators to raise/lower or extend/retract the support structure at the base to raise/lower the device, such as the plywood removing device or the beam removing device, attached at the upper end of the support structure. The controller may also control one or more hydraulic actuators to extend or pivot or articulate the device and to operate the device to remove and move the plywood or beam.

Thus, a method for removing formwork from underneath a cured concrete slab in accordance with the present invention includes providing a wheeled base movable on and supported at a support structure, a raisable and lowerable structure disposed on the wheeled base, and a formwork-removal device attached to the raisable and lowerable structure. The formwork-removal device comprises (i) an arm extending from the raisable and lowerable structure, (ii) at least one wedge element disposed at a distal end of the arm, and (iii) a formwork-retaining mechanism. The method includes moving the wheeled base along the support structure to position the machine below or near formwork to be removed from the ceiling above the machine, and adjusting the raisable and lowerable structure adjusted to raise the wedge element and to position the wedge element at and in engagement with the formwork and an underside of the concrete slab. With the raisable and lowerable structure adjusted to raise the wedge element and with the wedge element positioned to engage the formwork and an underside of a concrete slab, the method includes moving the wedge element relative to the formwork to apply a separating force to separate part of the formwork from the underside of the concrete slab. With the wedge element engaged with the formwork and the underside of the concrete slab, the method includes operating the formwork-retaining mechanism to grasp the part of the formwork that is separated from the underside of the concrete slab to retain the formwork at the formwork-removal device. With the formwork grasped by the formwork-retaining mechanism, the method includes lowering the raisable and lowerable structure to remove the formwork from the underside of the concrete slab. The machine may be moved to a drop-off location where the formwork-retaining mechanism is operated to release the part of the formwork to drop the removed formwork at the targeted drop-off location.

Also, a method for removing beams from underneath formwork at an underside of a cured concrete slab in accordance with the present invention includes providing a wheeled base movable on and supported at a support structure, a raisable and lowerable structure disposed on the wheeled base, and a beam-removal device coupled to the raisable and lowerable structure. The beam-removal device comprises a beam-gripping mechanism. The method includes moving the wheeled base along the support structure to position the machine below or near a beam to be removed from the ceiling above the machine, and adjusting the raisable and lowerable structure adjusted to raise the beam-removal device and to position the beam-removal device at the beam at an underside of the concrete slab. With the raisable and lowerable structure raised to position the beam-removal device at the beam that supports the formwork at the underside of the concrete slab, the method includes operating the beam-gripping mechanism to grasp the beam and, with the beam grasped by the beam-gripping mechanism, operating the machine to remove the beam from the formwork (such as by twisting and/or lowering the beam-gripping mechanism with the beam grasped thereat). With the removed beam grasped by the beam-retaining mechanism, the method includes lowering the raisable and lowerable structure. The machine may be moved to a drop-off location where the beam-retaining mechanism is operated to release the removed beam to drop the beam at the targeted drop-off location.

Optionally, the machine may be operated to facilitate installation of formwork, before the concrete is placed and cured. For example, the machine may lift or raise beams into position at the upper ends of the posts, and/or the machine may lift or raise plywood panels into position on top of the beams prior to pouring the concrete slab. The operator may remotely control the beam-removal device to sequentially install each formwork beam by gripping each beam from its stored location and raising/repositioning the beam to engage with previously installed beams or shoring posts, then releasing the gripping mechanism. Similarly, the operator may remotely control the formwork-removal device to hold the plywood formwork in its gripping mechanism and raise/reposition the plywood formwork to its installation point for installation.

The positioning of the beams and/or plywood panels at the upper ends of the posts may be responsive at least in part to a laser leveling device to ensure that the beams and plywood are at the appropriate height and are level. Such laser leveling devices utilize a laser plane generator and laser receivers, which may be disposed at the beam or formwork removal device and/or at the raisable/lowerable structure to determine when the laser receiver(s) is at a particular height or level corresponding to the generated laser plane, which effectively sets the height of the device at an appropriate or selected height for its particular function, and may utilize aspects of the systems described in U.S. Pat. Nos. 4,655,633; 4,930,935; 6,976,805; 7,044,681; 7,121,762; 7,144,191; 7,195,423 and/or 7,396,186, which are hereby incorporated herein by reference in their entireties. Optionally, during the removal process or processes, the positioning of the removal devices may be responsive at least in part to such a laser leveling system.

Changes and modifications to the specifically described embodiments can be carried out without departing from the principles of the present invention, which is intended to be limited only by the scope of the appended claims as interpreted according to the principles of patent law.

The invention claimed is:

1. A machine for removing formwork from underneath a concrete slab, the machine comprising:

a wheeled base movable on and supported at a support structure;

a raisable and lowerable structure disposed on the wheeled base;

a formwork-removal device attached to the raisable and lowerable structure, the formwork-removal device comprising (i) an arm extending from the raisable and lowerable structure and (ii) at least one pneumatic gripper disposed at a distal end of the arm;

wherein, with the raisable and lowerable structure adjusted to position the at least one pneumatic gripper under the formwork and engaged with the formwork, and when the at least one pneumatic gripper is activated, the at least one pneumatic gripper applies a suction to secure the formwork at the at least one pneumatic gripper; and wherein, with the formwork secured at the at least one pneumatic gripper, and when the at least one pneumatic gripper is lowered, the at least one pneumatic gripper applies a separating force to the formwork to remove the formwork from the concrete slab.

2. The machine of claim 1, wherein the at least one pneumatic gripper, when deactivated, discontinues applying the suction to release the formwork.

3. The machine of claim 1, wherein the raisable and lowerable structure comprises an extendable and retractable arm.

4. The machine of claim 1, wherein the raisable and lowerable structure comprises an articulating arm.

5. The machine of claim 1, wherein the raisable and lowerable structure comprises a scissor lift structure that is operable to vertically move the formwork-removal device relative to the wheeled base.

6. The machine of claim 5, wherein the formwork-removal device is coupled to the raisable and lowerable structure via an extendable and retractable arm.

7. The machine of claim 5, wherein the formwork-removal device is coupled to the raisable and lowerable structure via an articulating arm.

8. The machine of claim 1, wherein the wheeled base, the raisable and lowerable structure and the at least one pneumatic gripper are operated via a remote controller that is in wireless communication with the machine.

9. The machine of claim 1, wherein the wheeled base, the raisable and lowerable structure and the at least one pneumatic gripper are operated via an operator interface at the machine, and wherein the operator interface is operated via an operator riding on the machine.

10. The machine of claim 1, wherein the wheeled base comprises at least three wheels, and wherein at least one of the wheels is steerable to steer the wheeled base while the machine moves over the support structure.

11. The machine of claim 1, wherein the wheeled base comprises at least three wheels, and wherein at least one of the wheels is rotatably driven to move the machine over the support structure.

12. The machine of claim 1, wherein the wheeled base comprises one or more tracks disposed at respective wheels, and wherein the one or more tracks, when driven by one or more wheels of the wheeled base, move the machine over the support structure.

13. The machine of claim 1, further comprising a receptacle disposed beneath the formwork-removal device to receive the formwork that is removed from the concrete slab and released by the at least one pneumatic gripper.

14. The machine of claim 1, wherein the machine is operable responsive at least in part to a laser-leveling system, and wherein the formwork-removal device positions the at least one pneumatic gripper responsive at least in part to sensing a laser plane generated by the laser-leveling system.

15. The machine of claim 14, wherein the machine is operable to position formwork at support beams prior to placing and curing the concrete slab, and wherein the raisable and lowerable structure and the formwork-removal device are operable responsive at least in part to the laser-leveling system.

16. The machine of claim 15, wherein a laser receiver is disposed at the raisable and lowerable structure, and wherein the machine positions formwork responsive to the laser receiver sensing the generated laser plane.

17. The machine of claim 15, wherein a laser receiver is disposed at the formwork-removal device, and wherein the machine positions formwork responsive to the laser receiver sensing the generated laser plane.

* * * * *